US005343956A

United States Patent [19]

Coronado

[11] Patent Number: 5,343,956

[45] Date of Patent: Sep. 6, 1994

[54] COILED TUBING SET AND RELEASED RESETTABLE INFLATABLE BRIDGE PLUG

[75] Inventor: Martin P. Coronado, Houston, Tex.

[73] Assignee: Baker Hughes Incorporated, Houston, Tex.

[21] Appl. No.: 998,979

[22] Filed: Dec. 30, 1992

[51] Int. Cl.[5] ..... E21B 23/06

[52] U.S. Cl. ..... 166/387; 166/123; 166/182; 166/187

[58] Field of Search ..... 166/385, 386, 387, 123, 166/125, 181, 182, 187, 188

[56] References Cited

U.S. PATENT DOCUMENTS

| | | | |
|---|---|---|---|
| 3,921,720 | 11/1975 | Wetzel | 166/187 X |
| 4,082,298 | 4/1978 | Sanford | 166/187 |
| 4,237,979 | 12/1980 | Weise | 166/315 |
| 4,460,040 | 7/1984 | Bowyer | 166/129 |
| 4,566,535 | 1/1986 | Sanford et al. | 166/113 |
| 4,633,952 | 1/1987 | Ringgenberg | 166/336 |
| 4,646,829 | 3/1987 | Barrington et al. | 166/125 |
| 4,648,448 | 3/1987 | Sanford et al. | 166/191 |
| 4,688,634 | 8/1987 | Lustig et al. | 166/120 |
| 4,708,208 | 11/1987 | Halbardier | 166/387 |
| 4,714,117 | 12/1987 | Dech | 166/380 |
| 4,750,564 | 6/1988 | Pettigrew et al. | 166/123 X |
| 4,768,590 | 9/1988 | Sanford et al. | 166/187 |
| 4,796,707 | 1/1989 | Halbardier | 166/387 |
| 4,805,699 | 2/1989 | Halbardier | 166/387 |
| 4,815,538 | 3/1989 | Burroughs | 166/312 |
| 4,823,882 | 4/1989 | Stokley et al. | 166/387 |
| 4,869,324 | 9/1989 | Holder | 166/387 |
| 4,869,325 | 9/1989 | Halbardier | 166/387 |
| 4,907,655 | 3/1990 | Hromas et al. | 166/321 |
| 4,951,747 | 8/1990 | Coronado | 166/187 |
| 4,962,815 | 10/1990 | Schultz et al. | 166/387 |
| 5,000,265 | 3/1991 | Pleasants et al. | 166/387 |
| 5,012,871 | 5/1991 | Pleasants et al. | 166/386 |
| 5,020,600 | 6/1991 | Coronado | 166/387 |
| 5,090,481 | 2/1992 | Pleasants et al. | 166/373 |
| 5,143,015 | 9/1992 | Lubitz et al. | 166/187 |
| 5,217,077 | 6/1993 | Hart | 166/187 X |

*Primary Examiner*—Terry Lee Melius
*Attorney, Agent, or Firm*—Melvin A. Hunn; Mark W. Handley

[57] ABSTRACT

A resettable wellbore tool is provided for running into a wellbore on a workstring, and hydraulically actuating to urge into setting engagement with a wellbore surface. The resettable wellbore tool includes a fluid control member which is resettable between a latched closed position for locking out fluid pressure from the resettable wellbore tool to prevent inadvertent actuation while an operating pressure is applied to a central bore of the workstring, and an open position for passing pressurized fluid into the resettable wellbore tool. The resettable wellbore tool further includes a release latch which is repeatably latchable and unlatchable for releasably securing the resettable wellbore tool to the workstring. The resettable wellbore tool is operable for urging into a setting engagement at a first depth within the wellbore, being released from the workstring, then relatched to the workstring for resetting into the setting engagement at a second depth within the wellbore. The resettable wellbore tool may also be run into the wellbore on a workstring, urged into the setting engagement, and then later released from the setting engagement for retrieval from the wellbore through a production tubing string run into the wellbore subsequent to removal of the workstring from the wellbore.

42 Claims, 27 Drawing Sheets

COILED TUBING SET AND RELEASED RESETTABLE INFLATABLE BRIDGE PLUG

BACKGROUND OF THE INVENTION

1. Field of the Invention

This invention relates in general to fluid-actuated wellbore tools for setting in a wellbore, and in particular to tubing conveyed inflatable packers and bridge plugs which are set within a wellbore, then released from the tubing string by which they are conveyed, and later resecured to the tubing string for retrieval from the wellbore.

2(a). Background of the Invention

During operations for treating productive, hydrocarbon bearing earth formations to enhance production of oil and gas from wellbores, frequently well treatment tools, such as fracturing tools and wash tools, are utilized for pumping treatment fluids into these productive formations. Wash tools and fracturing tools typically have seal cups which are used for sealing a wellbore to direct treatment fluids into a productive formation. Often seal cups deteriorate and require replacement before efficient completion of formation treatment operations.

When seal cups require replacement, it may be desirable to provide a wellbore tool for sealing the wellbore to prevent fluid within the wellbore from flowing into productive formations when a wash tool or fracturing tool is being removed from the wellbore to replace deteriorated seal cups. If more than one productive formation is in fluid communication with the wellbore, it may be desirable to seal the wellbore to prevent cross-flow between productive formations. It may also be desirable to provide a wellbore tool for sealing the wellbore to prevent fluid flow from before the completion of well treatment operations, until after production tubing is run into the wellbore, and then later selectively allow fluid flow after the production tubing is set within the wellbore.

A wellbore tool for use to seal a wellbore and allow repeated retrieval of a wash tool or fracturing tool during well treatment operations requires a wellbore tool which is settable into sealing engagement within the wellbore, which is releasable from the workstring, which can be recoupled to the workstring for release from sealing engagement, and which is resettable for setting again into sealing engagement within the wellbore. Further, a wellbore tool for use to selectively prevent fluid flow within the wellbore from before the completion of well treatment operations, until after production tubing is run and set within a wellbore, requires a wellbore tool for running into the wellbore on a workstring, and then later either retrieved through production tubing or reset at another depth within the wellbore.

2(b). Description of the Prior Art

Hydraulically actuated wellbore tools, such as inflatable packers and inflatable bridge plugs, have been used for sealingly engaging wellbore surfaces to prevent fluid flow within wellbores. Some hydraulically actuated packers and bridge plugs are settable into sealing engagement within the wellbore, releasable from sealing engagement, and then resettable back into sealing engagement.

Other hydraulically actuated packers may be lowered within a wellbore on a workstring such as, for example, a coiled tubing string or a threaded tubing string, hydraulically urged into setting engagement, and then released from the workstring. Some of these packers may be recoupled to the workstring for release from setting engagement and retrieval from the wellbore.

Still other hydraulically actuated wellbore tools are inflatable packers which are run as part of a casing string for use in sealing an annulus between the casing string and a wellbore surface, such as the surface a borehole drilled through earth formations. These inflatable packers may be used as external casing packers for sealing against flow of formation fluid between different formation intervals about the wellbore. These inflatable, external casing packers are sometimes inflated by a straddle packer tool secured to a coiled tubing string which is lowered within the external casing packer for passing pressurized fluid to inflate the external casing packer into sealing engagement with the wellbore surface. Often these inflatable, external casing packers are cemented in place with the casing string to become permanently set within the wellbore.

However, none of the above hydraulically actuated wellbore tools are settable into sealing engagement within a wellbore, releasable from the workstring to allow retrieval of the workstring and a wash tool or fracturing tool during well treatment operations, resecurable to the workstring for release from setting engagement, and resettable into sealing engagement within the wellbore to allow further release from the workstring after being resecured to the workstring and released from setting engagement on a single trip into the wellbore.

SUMMARY OF THE INVENTION

It is one objective of the present invention to provide a hydraulically actuated wellbore tool for lowering within a wellbore coupled to workstring, hydraulically actuating into a setting engagement with a wellbore surface, releasing from the workstring, and then recoupling to the workstring for releasing from setting engagement and retrieval from the wellbore.

It is another objective of the present invention to provide a hydraulically actuated wellbore tool for lowering into a wellbore on a workstring, actuating into a setting engagement at a first depth within the wellbore by filling with a pressurized fluid from a source of pressurized fluid which is run within the workstring, releasing from the workstring, and then later resecuring to the workstring for repositioning and resetting again into the setting engagement at another depth within the wellbore.

It is still another objective of the present invention to provide a hydraulically actuated wellbore tool for lowering into the wellbore coupled to a workstring, urging into a setting engagement with a wellbore surface by filling with a pressurized fluid, releasing from the setting engagement with the workstring by unlatching a release latch which can only be unlatched after the hydraulically actuated wellbore tool is fully actuated, and later recoupling to the workstring for further positioning and resetting at a different depth within the wellbore.

It is yet another objective of the present invention to provide a hydraulically actuated wellbore tool for running into a wellbore on a workstring below an upper fluid operated wellbore tool, the hydraulically actuated wellbore tool including a fluid control member for locking out fluid pressure to prevent inadvertent hydraulic actuation of the hydraulically actuated wellbore tool during operation of the upper fluid operated wellbore tool, the hydraulically actuated wellbore tool further being settable into a setting engagement with a wellbore surface, releasable from the workstring, and resecurable to the workstring for further operations for resetting into setting engagement with the wellbore surface within the wellbore and release from the workstring.

These objectives are achieved as is now described. A resettable wellbore tool is provided for running into a wellbore on a workstring, and hydraulically actuating to urge into setting engagement with a wellbore surface. The resettable wellbore tool includes a fluid control member which is resettable between a latched closed position for locking out fluid pressure from the resettable wellbore tool to prevent inadvertent actuation while an operating pressure is applied to a central bore of the workstring, and an open position for passing pressurized fluid into the resettable wellbore tool. The resettable wellbore tool further includes a release latch which is repeatably latchable and unlatchable for releasably securing the resettable wellbore tool to the workstring. The resettable wellbore tool is operable for urging into a setting engagement at a first depth within the wellbore, being released from the workstring, then relatched to the workstring for resetting into the setting engagement at a second depth within the wellbore. The resettable wellbore tool may also be run into the wellbore on a workstring, urged into the setting engagement, and then later released from the setting engagement for retrieval from the wellbore through a production tubing string run into the wellbore subsequent to removal of the workstring from the wellbore.

In the preferred embodiment of the present invention, a resettable wellbore tool is provided for running into a wellbore in a workstring below a well treatment tool. The preferred embodiment of the resettable wellbore tool of the present invention is a hydraulically actuated wellbore tool which includes an inflatable bridge plug and a release latch. The inflatable bridge plug includes an inflatable packer which is filled with a pressurized fluid and urged into a setting engagement with a wellbore surface, a fluid control member for controlling inflation of the inflatable packer, and a retrievable bridge plug for sealing a central bore through the inflatable packer. The release latch includes a ratchet latch and a hydraulic lock for selectively securing the inflatable packer to the workstring. The hydraulic lock prevents release of the inflatable packer from the workstring until after the inflatable packer is fully inflated into setting engagement within the wellbore surface.

The resettable wellbore tool of the preferred embodiment of the present invention is operated by lowering a source of pressurized fluid within the workstring for inflating the inflatable packer. In the preferred embodiment, the source of pressurized fluid is a coiled tubing string, to the lower end of which an inflation tool is secured for releasably engaging the resettable wellbore tool. The coiled tubing string and inflation tool are mechanically manipulated to initiate operation of the fluid control member. Pressurized fluid is then passed down the coiled tubing string, through the inflation tool, and to the resettable wellbore tool for further operation of the fluid control member and for urging the inflatable bridge plug into setting engagement with the wellbore surface. After the pressurized fluid fully inflates the inflatable packer, the pressurized fluid then urges the hydraulic lock to unlock the release latch to allow release of the inflatable packer from the workstring so that the workstring and well treatment tool may be removed from the wellbore while the inflatable bridge plug prevents fluid flow through the wellbore.

After the well treatment tool and workstring are returned into the wellbore, the workstring may be relatchedto the inflatable bridge plug. In the preferred embodiment of the present invention, a deflation tool is lowered into the wellbore on a coiled tubing string, which is lowered within the workstring for mechanically manipulating the fluid control member. The deflation tool and coiled tubing are manipulated to release the pressurized fluid, relock the hydraulic lock, and deflate the inflatable bridge plug. Once the inflatable bridge plug is relatched to the workstring and deflated, the fluid control member may then be operated to seal the resettable wellbore tool from the central bore of the workstring so that well treatment operations can continue.

The resettable wellbore tool may later be reset into setting engagement within the wellbore if later removal of the well treatment tool and sealing of the wellbore to prevent fluid flow within the wellbore is required. Once reset into setting engagement, the resettable wellbore tool may again be recoupled to the workstring, released from setting engagement, repositioned within the wellbore, and again releasably reset into setting engagement within the wellbore.

Further, the resettable wellbore tool may be set within the wellbore for sealing the wellbore after well treatment operations are finished, and during further well completion operations. The resettable wellbore tool may be removed from the wellbore after a production tubing string is set in the wellbore above the resettable wellbore tool. In the preferred embodiment of the present invention, a coiled tubing string and a retrieval tool are run through the production tubing and into the wellbore for latching to the resettable wellbore tool, deflating the inflatable packer, and then withdrawing the inflatable packer through the production tubing string and from the wellbore.

Additional objects, features, and advantages will be apparent in the written description which follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
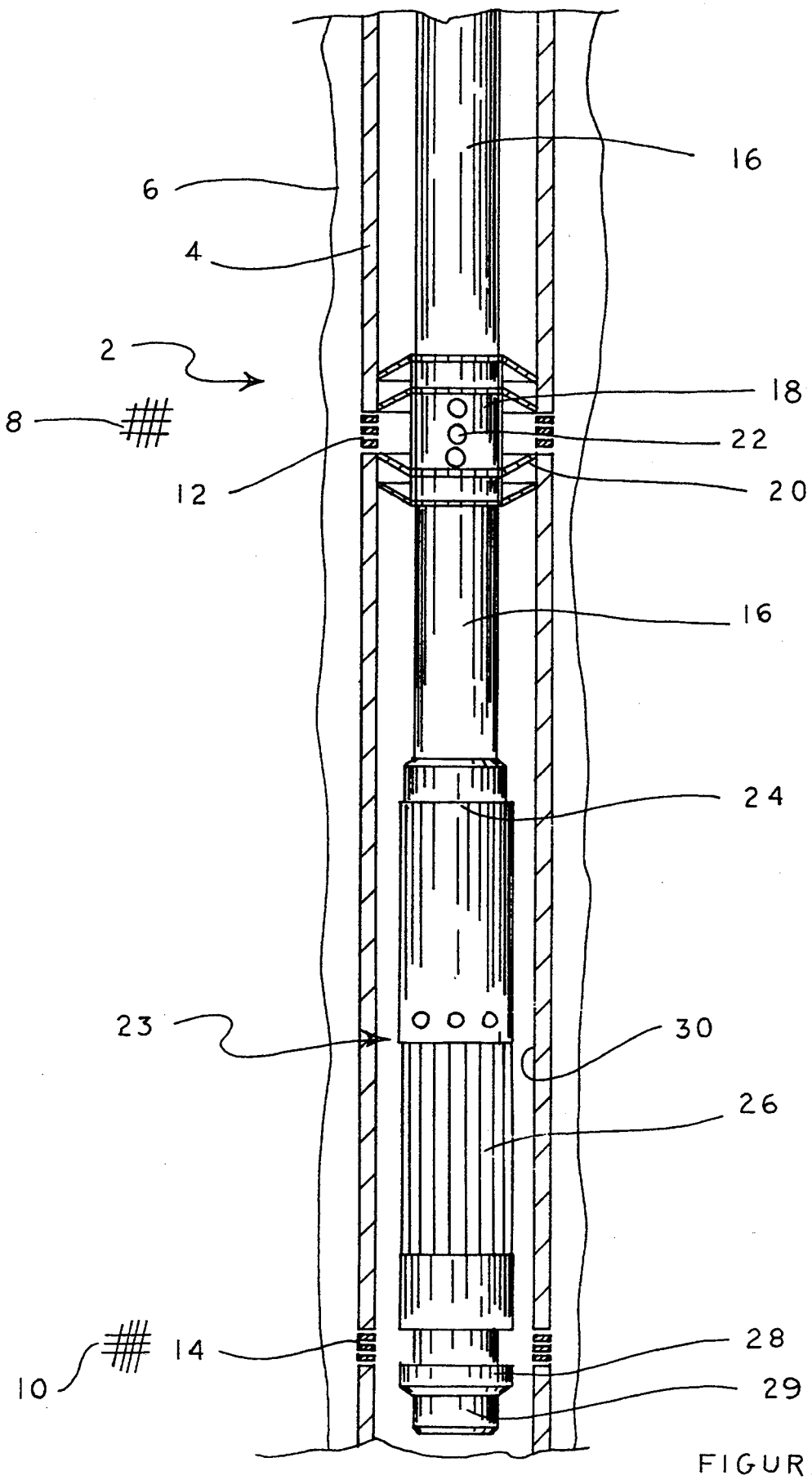
FIG. 1 is a perspective view of a wellbore tool string which includes a well treatment tool and the resettable wellbore tool of the present invention having an inflatable bridge plug which is shown in a deflated position secured to the lower end of a workstring.

With reference to FIG. 1, a perspective view shows the preferred embodiment of the present invention included in tool string 2, which is shown disposed within casing 4 in wellbore 6. Wellbore 6 has an upper formation 8 and a lower formation 10 with perforations 12 establishing fluid communication between the interior of casing 4 and formation 8, and perforations 14 establishing fluid communication between the interior of casing 4 and lower formation 10.

Tool string 2 includes workstring 16, and well treatment tool 18 secured to workstring 16. Well treatment tool 18 is a fluid operated wellbore tool, such as a wash tool or fracturing tool, which includes seal cups 20 and well treatment tool flow ports 22. Seal cups 20 seal within casing 4 so that a pressurized well treatment fluid flowing down central bore 16 (not shown in FIG. 1) of workstring 16 and through well treatment tool flow ports 22 will be forced through perforations 12, into an annulus between casing 4 and wellbore 6, and into upper formation 8 rather than traveling upwards or downwards from well treatment tool 18 within casing 4.

Below well treatment tool 18 is another section of workstring 16 to which is secured resettable wellbore tool 23, the preferred embodiment of the present invention. Resettable wellbore tool 23 includes release latch 24 and inflatable bridge plug 26. Release latch 24 is a resettable wellbore tool utilized in the preferred embodiment of the present invention for selectively coupling inflatable bridge plug 26 to workstring 16. Inflatable bridge plug 26 is also a resettable wellbore tool, which in the preferred embodiment of the present invention, includes gauge ring 28 and landing nipple 29.

Frequently during well treatment operations, such as, for example, fracturing operations, seal cups 20 of well treatment tool 18 wear out and require replacement. When two sets of perforations, such as perforations 12 and perforations 14, are in a wellbore providing fluid communication between two separate formation zones, such as upper formation zone 8 and lower formation zone 10, it is often necessary to seal the wellbore between the two formation zones to prevent fluid communication therebetween. In a well treatment operation such as that shown in FIG. 1, very often one formation, such as lower formation 10, may be susceptible to loading up, or having fluid flow from casing 4, through perforations 14, and into lower formation 10 which may damage formation 10, and thus prevent later hydrocarbon production from that zone. So, when removing well treatment tool 18 from wellbore 6, casing 4 should be sealed to prevent fluid communication through casing 4 and perforations 14, and into formation zone 10.

In the preferred embodiment of the present invention, resettable wellbore tool 23 having inflatable bridge plug 26 is provided for urging into a setting engagement with wellbore surface 30 to prevent fluid communication down casing 4, through perforations 14 and into formation 10 as well treatment tool 18 is being removed from wellbore 6 for replacement of seal cups 20. Resettable wellbore tool 23 is depicted for sealing against wellbore surface 30, which in the preferred embodiment of the present invention is an interior surface of a casing 4. It should be noted, however, that in other embodiments of the present invention, resettable wellbore tool 23 may be used for sealing against a wellbore surface which is not an interior surface of a casing, such as, for example, the surface of wellbore 6.

Figure 2:
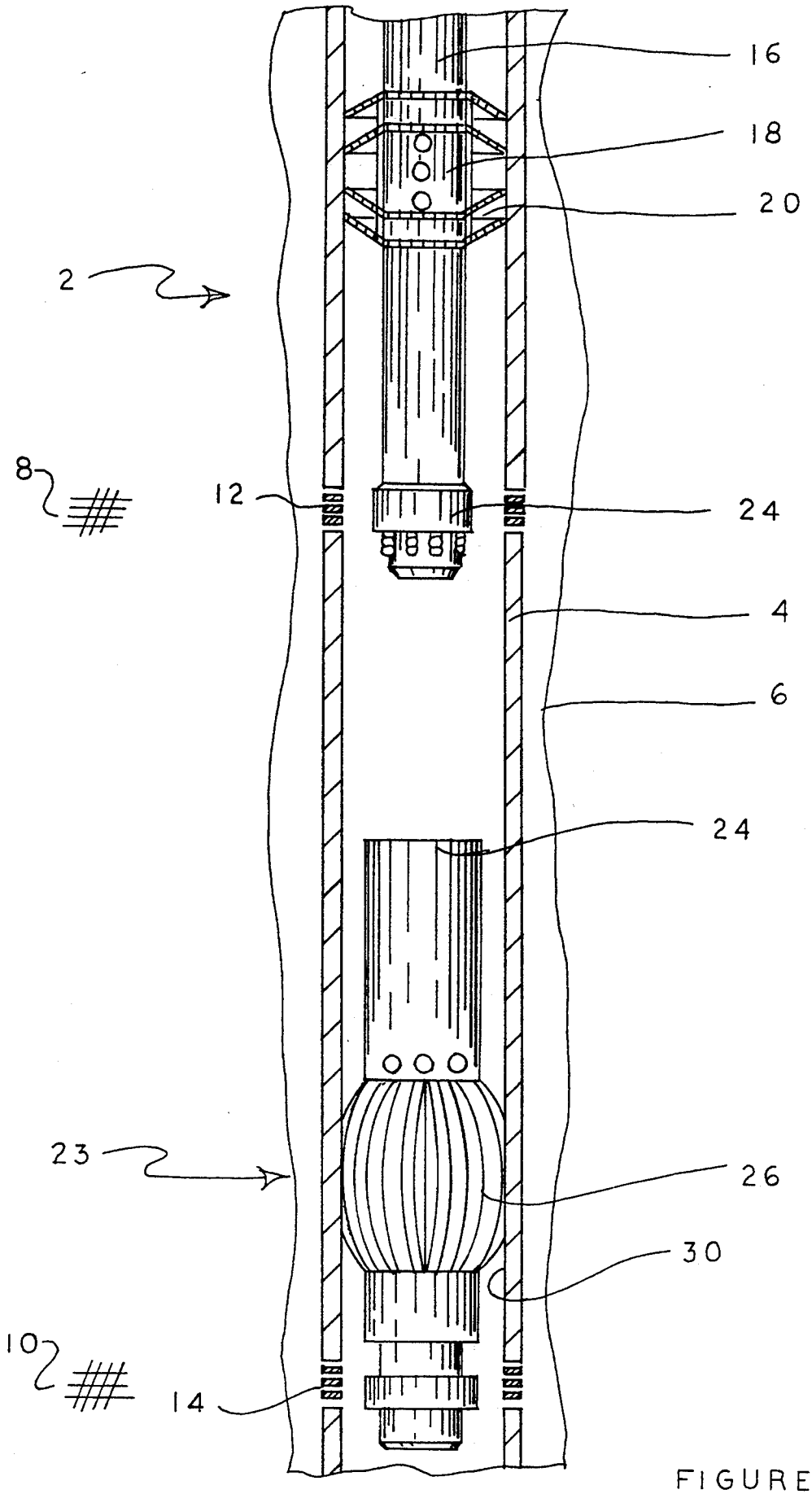
FIG. 2 is a perspective view of the wellbore tool string of FIG. 1 which includes a well treatment tool and the resettable wellbore tool of the present invention, showing the inflatable bridge plug after release from the workstring in an inflated position in gripping and sealing engagement with a wellbore surface.

Referring to FIG. 2, a perspective view of tool string 2 depicts resettable wellbore tool 23, and shows inflatable bridge plug 26 in an inflated position in a setting engagement for grippingly and sealingly engaging wellbore surface 30 within wellbore 6, released from workstring 16, and also shows well treatment tool 18 being removed from wellbore 6. In the preferred embodiment of the present invention, resettable wellbore tool 23 is a hydraulically actuated wellbore tool which includes fluid inflatable bridge plug 26 which may be inflated to sealingly engage wellbore surface 30 of casing 4 to prevent fluid communication down casing 4, through perforations 14, and into lower formation 10. Release latch 24 is provided so that after inflatable bridge plug is set within casing 4, workstring 16 may be uncoupled from inflatable bridge plug 26 to allow removal of well treatment tool 18 for replacement of seal cups 20.

After replacement of seal cups 20, workstring 16 and well treatment tool 18 may be lowered back within wellbore 6, and release latch 24 may be recoupled for resecuring inflatable bridge plug 26 to workstring 16.

Inflatable bridge plug 26 may then be deflated so that tool string 2 may be repositioned within wellbore 6 and well treatment operations continued. Further, resettable wellbore tool 23 may be operated to reset inflatable bridge plug 26 into setting engagement within wellbore surface 30 to again prevent fluid communication within a portion of casing 4, and reset release latch 24 to uncouple inflatable bridge plug 26 from workstring 16 so that seal cups 20 on well treatment tool 18 can again be replaced.

Figure 3A:
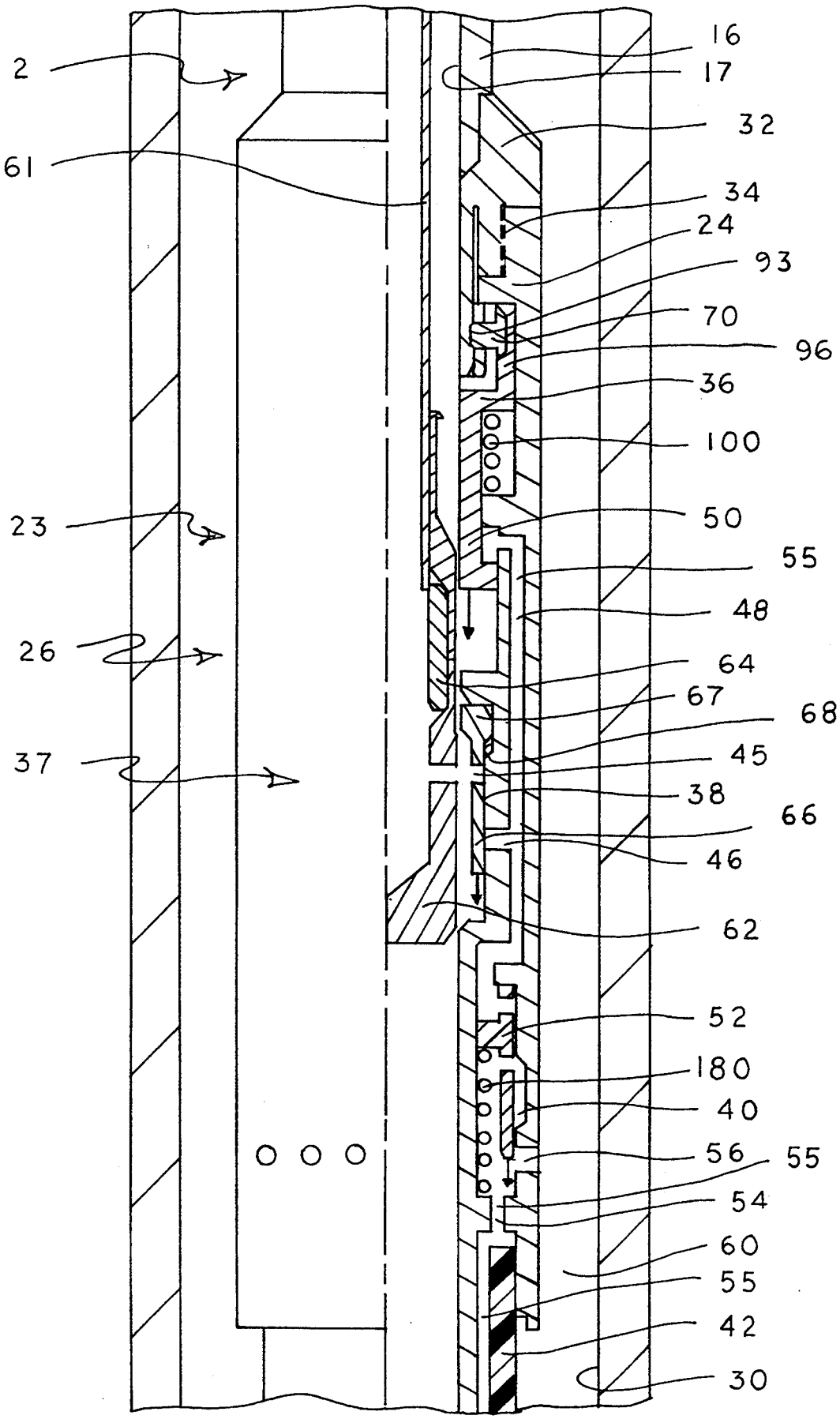
FIGS. 3*a* and 3*b* are schematic diagrams depicting in one-quarter longitudinal section view the resettable wellbore tool of the present invention having a release latch and inflatable bridge plug shown in a deflated position secured to the lower end of the workstring within a wellbore casing, which is shown in a full longitudinal section view.
Figure 3B:
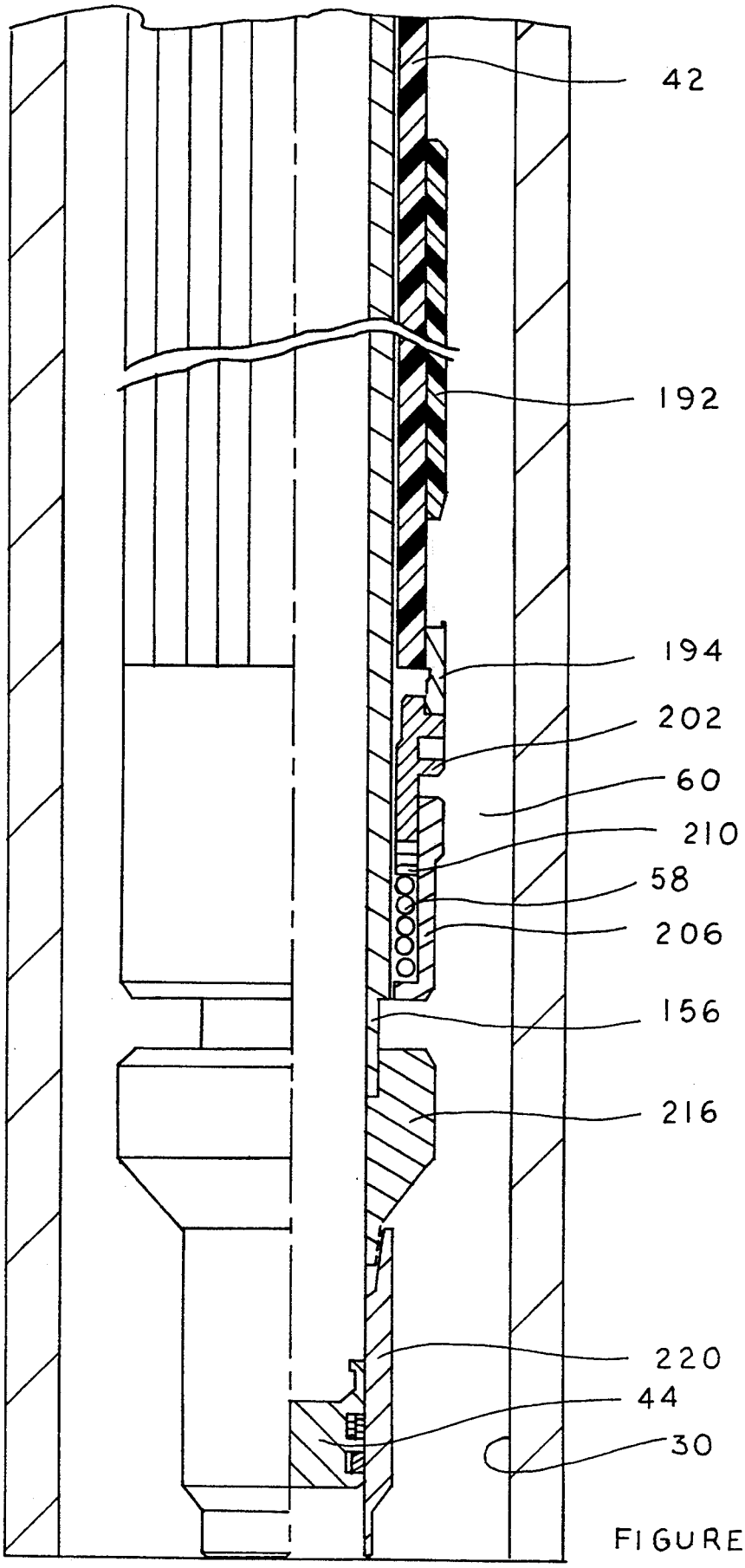

With reference to FIGS. 3*a* and 3*b*, schematic diagrams depict, in one-quarter longitudinal section view, resettable wellbore tool 23, which in the preferred embodiment of the present invention includes two resettable wellbore tools, release latch 24 and inflatable bridge plug 26. Release latch 24 and bridge plug 26 together include upper adapter 32, ratchet latch 34, hydraulic lock 36, pressurization valve 38, deflation valve 40, inflatable packer 42, and retrievable plug 44.

Release latch 24 includes ratchet latch 34 and hydraulic lock 36. Ratchet latch 34 is a collet type of latch which may be coupled by ratcheting engagement, and uncoupled by application of 10,000 pounds longitudinal force which causes a set of collet fingers to flex inward and ratchet latch 34 to separate. Hydraulic lock 36 prevents separation of ratchet latch 34 until a predetermined amount of fluid pressure is applied through central bore 17 of workstring 16 and to inflatable bridge plug 26 which is sufficient to urge inflatable packer 42 into setting engagement with wellbore surface 30. Release latch 24 is resettable since ratchet latch 34 and hydraulic lock 36 may be selectively operated numerous times on a single trip into wellbore 6.

Fluid control member 37 includes pressurization valve 38 and deflation valve 40. Pressurization valve 38 includes flow ports 45 and a valve member, valve sleeve 66, which is initially latched in a closed position and which may be selectively moved from a closed position to an open position. When pressurization valve 38 is selectively moved to an open position, flow ports 45 are placed in alignment with inflation ports 46 to selectively provide fluid communication from fluid flow ports 45, through inflation ports 46, and into pressurization fluid flowpath 48. Pressurization fluid flowpath 48 provides fluid communication between inflation ports 46, and both hydraulic lock 36 and deflation valve 40. Fluid pressure applied through inflation ports 46 and into pressurization fluid flowpath 48 first actuates deflation valve 40 at a first predetermined fluid pressure level, and second actuates hydraulic lock 36 at a second predetermined fluid pressure level, which also fully sets inflatable packer 42.

Deflation valve 40 is selectively actuated when fluid pressure at a first predetermined level is selectively applied through pressurization fluid flowpath 48 to urge ported annular piston 52, which is spring biased, to move from a deflation position, as shown in FIGS. 3*a* and 3*b*, to an inflation position. Ported annular piston 52 is a repeatably moveable, spring-biased valve member. When deflation valve 40 is in the inflation position, pressurization fluid flowpath 48 and packer fluid flowpath 54 are in fluid communication. Pressurization fluid flowpath 48 and packer fluid flowpath 54 together form a portion of fluid flowpath 55 of resettable wellbore tool 23. In the deflation position, deflation valve 40 provides fluid communication from packer fluid flowpath 54, to deflation ports 56, and into annulus 60 between the exterior of inflatable packer 42 and interior casing 4.

Hydraulic lock 36 is actuated when fluid pressure at a second predetermined fluid pressure level is selectively applied through pressurization fluid flowpath 48 to urge spring biased annular piston 50 to move from a locked position to an unlocked position, which releases hydraulic lock 36 to allow release of release latch 24.

Inflatable packer 42 includes a deflation bias spring 58 which provides a bias for urging inflatable packer 42 into a deflated position.

Shown interiorly of bridge plug 26 is coiled tubing 61 and inflation tool 62. Inflation tool 62 is coupled to coiled tubing 61 by coiled tubing adapter 64. Inflation tool 62 is lowered within workstring 16 and resettable wellbore tool 23 for selectively engaging pressurization valve sleeve 66, which is a moveable valve member. Pressurization valve sleeve 66 includes valve sleeve latch member 67 which latches into valve latch profile 68 for retaining valve sleeve 66 in the closed position.

Once inflation tool 62 is engaged with valve sleeve 66, coiled tubing 61 is moved downward and slides sleeve 66 downward from a closed position to an open position to align flow ports 45 with inflation ports 46. Flow ports 45 extend radially through pressurization valve sleeve 66.

After pressurization valve sleeve 66 is moved to an open position, pressurized fluid can then flow through coiled tubing 61, inflation tool 62, flow ports 45, inflation ports 46, and pressurization fluid flowpath 48, and to spring biased annular piston 50 and ported annular piston 52. After ported annular piston 52 is moved to a deflated position and inflatable packer 42 is fully inflated, fluid pressure then moves spring biased annular piston 50 downward and from abutment next to locking dogs 70 so that locking dogs 70 may be uncoupled from head adapter 32 allow release of ratchet latch 34.

Pressure applied through pressurization fluid flowpath 48, at the first predetermined fluid pressure level urges ported annular piston 52, which is spring biased, to move downward and seal deflation ports 56 from packer fluid flowpath 54, and allow fluid communication between pressurization fluid flowpath 48 and packer fluid flowpath 54. Pressurized fluid may then be pumped downward through coiled tubing 61, inflation ports 46, and fluid flowpath 55 to inflate inflatable packer 42. In the preferred embodiment of the present invention, the first predetermined fluid pressure level, which urges inflation of inflatable packer 42, is a lower level of fluid pressure than the second predetermined pressure level, which unlocks hydraulic lock 36.

Pressurized fluid within inflatable packer 42 at the second predetermined fluid pressure level urges inflatable packer 42 into a setting engagement with wellbore surface 30, which in the preferred embodiment of the present invention is a sealing and gripping engagement with casing 4. Hydraulic lock 36 is then actuated, or moved, to an unlocked position to allow release of ratchet latch 34. Workstring 16 can then be uncoupled from bridge plug 26 by separation of ratchet latch 34.

Referring to FIGS. 4*a* through 4*i*, one-quarter longitudinal section views are shown which, when read together, depict release latch 24 and inflatable bridge plug 26 of the present invention in a deflated position prior to initiating inflation and release from workstring 16. Upper adapter 32 is provided for connection to workstring 16 (not shown in FIGS. 4*a* through 4*i*). The upper end of upper latch sleeve 72 is threadingly connected to adapter 32 and seal 74 prevents fluid communication therebetween.

A collet sleeve 76 is threadingly connected to the lower end of upper adapter 32, and includes a plurality of threaded collet fingers 78. Collet sleeve 76 is secured from rotation within upper adapter 32 by set screw 80. Collet fingers 78 have a ratchet thread for engagement with mating ratchet threads on the interior of the upper end of anchor head 82 to form ratchet latch 34. The ratchet threads on collet fingers 78 provide at least one shoulder which, when in a latched position, releasably engage at least one mating shoulder provided by the mating ratchet threads on the interior of anchor head 82 for securing inflatable packer 42 to workstring 16. Seal 84 prevents fluid communication between upper latch sleeve 72 and anchor head 82.

The upper end of lower latch sleeve 86 threadingly engages the lower end of upper latch sleeve 72. Lock housing 88 threadingly engages the exterior of a lower portion of anchor head 82. Seal 90 prevents fluid communication between anchor head 82 and lock housing 88.

Locking dogs 70 extend circumferentially about and radially through anchor head 82, and into recess 93 in the lower end of lower latch sleeve 86. Garter springs 94 extend circumferentially about the exterior of locking dogs 70 and apply a biasing force for urging locking dogs 70 radially inward.

In the preferred embodiment of the present invention, spring biased annular piston 50, includes, as shown in FIGS. 4*a* through 4*i* and FIGS. 5*a* through 5*i*, lock sleeve 96 and sleeve piston 98. Still referring to FIGS. 4*a* through 4*i*, lock sleeve 96 extends between locking dogs 70 and lock housing 88 to provide a lock member for maintaining locking dogs 70 in securement within recess 93 in the lower end of lower latch sleeve 86. The lower end of lock sleeve 96 is threadingly engaged with the upper end of sleeve piston 98.

In between sleeve piston 98 and lock housing 88, bias spring 100 is positioned to provide a biasing force for urging lock sleeve 96 upward into a locked position and maintaining the upper end of lock sleeve 96 adjacent to locking dogs 70 for retaining locking dogs 70 in engagement within recess 93 in the lower end of lower latch sleeve 86. Adjustable preload sleeve 102 is provided to allow adjustment of a preload compression force within bias spring 100 so that the upward biasing force provided by bias spring 100 may be determined by rotating adjustable preload sleeve 102 about lock sleeve 96. Set screw 104 is provided for securing adjustable preload sleeve 102 with respect to lock sleeve 96 and sleeve piston 98 to maintain the adjustable preload compression force determined by rotating adjustable preload sleeve 102 about lock sleeve 96.

Spring housing 106 is threadingly secured to the lower end of lock housing 88. Pressurization valve housing 108 is threadingly secured to a lower portion of spring housing 106. Ported mandrel 110 is positioned interiorly of pressurization valve housing 108, with the upper end of ported mandrel 110 extending exteriorly of the lower end of spring housing 106 and the lower end of sleeve piston 98.

A portion of pressurization fluid flowpath 48 is defined between the interior of pressurization valve housing 108 and the exterior of ported mandrel 110. The upper end of ported mandrel 110 includes flow ports 112 for communicating fluid between pressurization fluid flowpath 48 and expandable chamber 114 formed between sleeve piston 98 and the lower end of spring housing 106. Seal 116 prevents fluid communication between the lower end of lock housing 88 and the upper end of spring housing 106. Seal 117 prevents fluid communication between the central portion of the exterior of spring housing 106 and the upper end of pressurization valve housing 108. Seal 118 seals between the lower end of spring housing 106 and an interior portion of sleeve piston 98. Seal 120 seals between the lower end of sleeve piston 98 and an interior portion of ported mandrel 110. Seals 118 and 120 contain fluid pressure within expandable chamber 114. Seal 118 provides a dynamic sealing engagement with an exterior portion of sleeve piston 98, which is relatively movable with respect to seal 118. Seal 120 provides a dynamic sealing engagement with an interior portion of ported mandrel 110 which is relatively moveable with respect to seal 120.

The upper end of pressurization valve mandrel 122 is threadingly engaged with the lower end of ported mandrel 110. Seal 124 prevents fluid communication between the lower end of ported mandrel 110 and the upper end of pressurization valve mandrel 122.

Pressurization valve sleeve 66 is positioned interiorly of and is selectively moveable with respect to pressurization valve mandrel 122 between a closed position and an open position, for selectively placing flow ports 45 in fluid communication with inflation ports 46. Pressurization valve sleeve 66 is shown in a closed position in FIGS. 4*a* through 4*i*, in which flow ports 45 are sealed from fluid communication with inflation ports 46. When pressurization valve sleeve 66 is moved to an open position (not shown in FIGS. 4*a* through 4*i*), flow ports 45 are in fluid communication with inflation ports 46.

In the preferred embodiment of the present invention, when in the closed position, pressurization valve sleeve 66 is latched into the closed position, or in a latched closed position, by valve sleeve latch member 67 engaging within valve latch profile 68. The preferred embodiment of pressurization valve sleeve 66 has a plurality of valve collet latch fingers 69 machined into the upper portion of valve sleeve 66. Collet latch fingers 69 are machined to provide an outward biasing force to urge valve sleeve latch member 67 into valve latch profile 68.

The upper end of ported sleeve 130 threadingly engages the lower end of pressurization valve mandrel 122. Ported sleeve 130 includes inflation ports 46 disposed radially through ported sleeve 130 to provide fluid communication between pressurization fluid flowpath 48 and flow ports 45 when pressurization valve sleeve 66 is positioned to place flow ports 45 in fluid communication with inflation ports 46. Upper seal retainer 134 and lower seal retainer 136 house seal 140 between the upper end of ported sleeve 130 and the exterior of pressurization valve sleeve 66. Seal 140 provides a dynamic sealing engagement with pressurization valve sleeve 66, which is movable relative to seal 140.

Seal 142 prevents fluid communication between the exterior of the upper end of ported sleeve 130 and the interior of the lower end of pressurization valve mandrel 122. Seal 144 prevents fluid communication between the exterior of lower seal retainer 136 and the interior of the upper end of ported sleeve 130. Seal 146 provides a dynamic sealing engagement between the interior of ported sleeve 130 and the exterior of pressurization valve sleeve 66, which is selectively movable relative to seal 146 and ported sleeve 130.

The upper end of coupling ring 148 threadingly engages the lower end of pressurization valve housing 108. Deflation valve housing 150 threadingly engages the lower end of coupling ring 148. Seal 152 prevents fluid communication between the lower end of pressurization valve housing 108 and the upper end of coupling ring 148. Seal 154 prevents fluid communication between the lower end of coupling ring 148 and the upper end of deflation valve housing 150.

The upper end of mandrel 156 threadingly engages the lower end of ported sleeve 130. Seal 158 prevents fluid communication between the upper end of mandrel 156 and the lower end of ported sleeve 130. Ported annular piston 52 is positioned between deflation valve housing 150 and mandrel 156. Ported annular piston 52 includes upper flow ports 162 and lower flow ports 164. Deflation ports housing 166 is positioned exteriorly about ported annular piston 52 and has an upper end which threadingly engages the lower end of deflation valve housing 150. Deflation ports housing 166 includes a flow groove 167 machined circumferentially about the interior of deflation ports housing 166. Deflation ports housing 166 further includes deflation ports 56 disposed radially through a lower portion of deflation ports housing 166.

Seal 170 provides a dynamic sealing engagement between mandrel 156 and ported annular piston 52, with seal 170 movable relative to mandrel 156. Seal 172 provides a dynamic sealing engagement between ported annular piston 52 and deflation ports housing 166, with ported annular piston 52 movable relative to seal 172. Seal 174 prevents fluid communication between the upper end of deflation ports housing 166 and the lower end of deflation valve housing 150. Seal 176 provides a dynamic sealing engagement between the lower portion of ported annular piston 52 and the interior of deflation ports housing 166, with ported annular piston 52 movable relative to seal 176 and deflation ports housing 166. Seal 178 provides a dynamic sealing engagement between deflation ports housing 166 and ported annular piston 52 when ported annular piston 160 is moved, or slides, to be positioned about seal 178. Further, bias spring 180 is positioned between mandrel 156 and ported annular piston 52 for providing a biasing force, which urges ported annular piston 52 into a deflation position as shown in FIGS. 4*a* through 4*i*.

Ported annular piston 52 is movable relative to mandrel 156 and deflation ports housing 166 into an inflation position, in which upper flow ports 162 and lower flow ports 164 are positioned about flow groove 167. Further, when ported annular piston 52 is placed in an inflation position, it extends between seal 176 and seal 178 to prevent fluid communication between deflation ports 56 and packer fluid flowpath 54. Ported annular piston 52 is shown in FIGS. 4*a* through 4*i* in a deflation position wherein ported annular piston 52 prevents fluid communication from pressurization fluid flowpath 48 into packer fluid flowpath 54, and packer fluid flowpath 54 is in fluid communication with annulus 60 through deflation ports 56. When a first predetermined amount of fluid pressure is provided within pressurization fluid flowpath 48, the fluid pressure exerts a downward force upon ported annular piston 52 sufficient to overcome bias spring 180 and urge ported annular piston from the deflation position, as shown in FIGS. 4*a* through 4*i*, to the inflation position as shown in FIGS. 5*a* through 5*i* to be discussed below.

Still referring to FIGS. 4*a* through 4*i*, the upper end of packer fluid flowpath housing 182 threadingly engages the lower end of deflation ports housing 166. Seal 184 prevents fluid communication between the upper end of packer fluid flowpath housing 182 and the lower end of deflation ports housing 166. Upper retainer ring 186 threadingly engages the lower end of packer fluid flowpath housing 182. Seal 188 prevents fluid communication between the lower end of packer fluid flowpath housing 182 and upper retainer ring 186.

Inflatable element 190 is disposed about mandrel 156. Inflatable element 190, in the preferred embodiment of the present invention, includes a plurality of overlapping support elements and elastomeric materials. Inflatable element 190 is inflated to radially expand into a setting engagement with wellbore surface 30, which in the preferred embodiment of the present invention provides both a gripping and sealing engagement within casing 4 (not shown in FIGS. 4*a* through 4*i*). Upper retainer ring 186 is provided to retain the upper end of inflatable element 190 in position about mandrel 156. Lower retainer ring 194 is provided about the lower end of inflatable element 190 to retain the lower end of inflatable element 190 about mandrel 156. Seal 196 is provided to seal against the interior of lower retainer ring 194 to prevent fluid communication from annulus 60 into the interior of bridge plug 26.

Packing sleeve 192 is provided about inflatable element 190, and in the preferred embodiment of the present invention, is comprised of elastomeric materials. When inflatable element 190 is inflated, packing sleeve 192 is urged by inflatable element 190 to radially expand, and is squeezed into wellbore surface 30 of casing 4 to provide the setting engagement for gripping and sealing with casing 4 (not shown in FIGS. 4*a* through 4*i*) in the preferred embodiment of the present invention.

Inflation chamber 200 is formed between the exterior of mandrel 156 and the interior of inflatable element 190, and is included as a portion of fluid flowpath 55 of resettable wellbore tool 23. Inflation chamber 200 is in fluid communication with packer fluid flowpath 54. Inflatable element 190 is inflated to urge packing sleeve 192 into gripping and sealing engagement within casing 4 by pressurized fluid passing through packer fluid flowpath 54 and into inflation chamber 200 to expand inflatable element 190 and urge packing sleeve 192 into gripping and sealing engagement.

The upper end of test port housing 202 is threadingly engaged to lower retainer ring 194, with seal 196 preventing fluid communication therebetween. Test port 204 extends radially through test port housing 202 for testing inflatable packer 42 prior to running tool string 2 into wellbore 6 (not shown in FIGS. 4*a* through 4*i*).

Spring housing 206 threadingly engages the lower end of test port housing 202. Deflation spring 58 is positioned between spring housing 206 and mandrel 156. Buttress ring 210 prevents upward movement of the upward end of deflation spring 58. Shear screw 212 secures spring housing 206 with respect to buttress ring 210 and prevents upward movement of spring housing 206 prior to shearing of shear screw 212. Shear screw 212 is provided for retaining inflatable element 190 in a deflated position as tool string 2 is lowered into casing 4 within wellbore 6 (not shown in FIGS. 4*a* through 4*i*).

Deflation spring 58 provides a downward biasing force which is applied through spring housing 206, test port housing 202, and lower retainer ring 194 to inflatable element 190 to urge inflatable element 190 into a deflated position. Inflation of the inflatable element 190 shears shear screw 212, which then allows deflation spring 58 to provide downward biasing force urging inflatable element 190 towards the deflated position. Shear screw 212 is provided to retain inflatable element 190 in the deflated position while tool string 2 is run into wellbore 6 (not shown in FIGS. 4*a* through 4*i*). Shear screw 212 resists frictional forces that arise from lowering inflatable element 190 within casing 4 in wellbore 6 (not shown in FIGS. 4*a* through 4*i*). Filling and pressurization of inflation chamber 200 to urge inflatable element 190 into an inflated position provides a sufficient upwards force for shearing shear screw 212.

Seal 214 provides a dynamic sealing engagement between mandrel 156 and test port housing 202, with seal 214 and test port housing 202 movable relative to mandrel 156 as inflatable element 190 is both inflated and deflated.

Referring to FIGS. 1, and 4*a* through 4*i*, gauge ring 216 threadingly engages the lower end of mandrel 156 and provides a gauge for assuring adequate clearance within casing 4 for passage of tool string 2. Seal 218 prevents fluid communication between the lower end of mandrel 156 and gauge ring 216.

The upper end of landing nipple 220 threadingly engages and couples landing nipple 220 to gauge ring 216, with threads 222 sealing therebetween. Retrievable blanking plug 44 is positioned within landing nipple 220 for sealingly engaging central bore 224 of landing nipple 220. Retrievable blanking plug 44 may be retrieved from within central bore 224 of landing nipple 220 by conventional means, such as coiled tubing, braided cable, wireline, or slick line.

With reference to FIGS. 5*a* through 5*i*, one-quarter longitudinal section views which, when read together, depict resettable wellbore tool 23 in a set position in gripping engagement with wellbore surface 30. Resettable wellbore tool 23 of the preferred embodiment of the present invention is shown including release latch 24, inflatable bridge plug 26, and coiled tubing inflation tool 62. Inflatable element 190 is shown after it has been inflated to urge packing sleeve 192 into setting engagement to provide the gripping and sealing engagement with wellbore surface 30 of casing 4 (not shown in FIGS. 5*a* through 5*i*) of the preferred embodiment of the present invention. Inflation tool 62 is shown coupled to the lower end of coiled tubing 61 by coiled tubing adapter 64.

Inflation tool 62 provides fluid communication between the interior of coiled tubing 61 and flow ports 45 when engaged in a latched position with pressurization valve sleeve 66. Inflation tool 62 also provides fluid communication for pressure equalization from the annular space between the exterior of coiled tubing 61 and the interior of pressurization valve sleeve 66 and workstring 16, and the interior space below inflation tool 62 disposed within the interior of mandrel 156. Further, inflation tool 62 mechanically couples with pressurization valve sleeve 66 to transmit force from coiled tubing 61 to sleeve 66 for removing valve sleeve latch member 67 from valve latch profile 68 and urging sleeve 66 from a closed position, or latched closed position, to an open position, and back into a latched closed position, which in the preferred embodiment of the present invention is the closed position. Pressurization valve sleeve 66 is resettable since it is repeatably moveable between the closed position and the open position.

Figure 6:
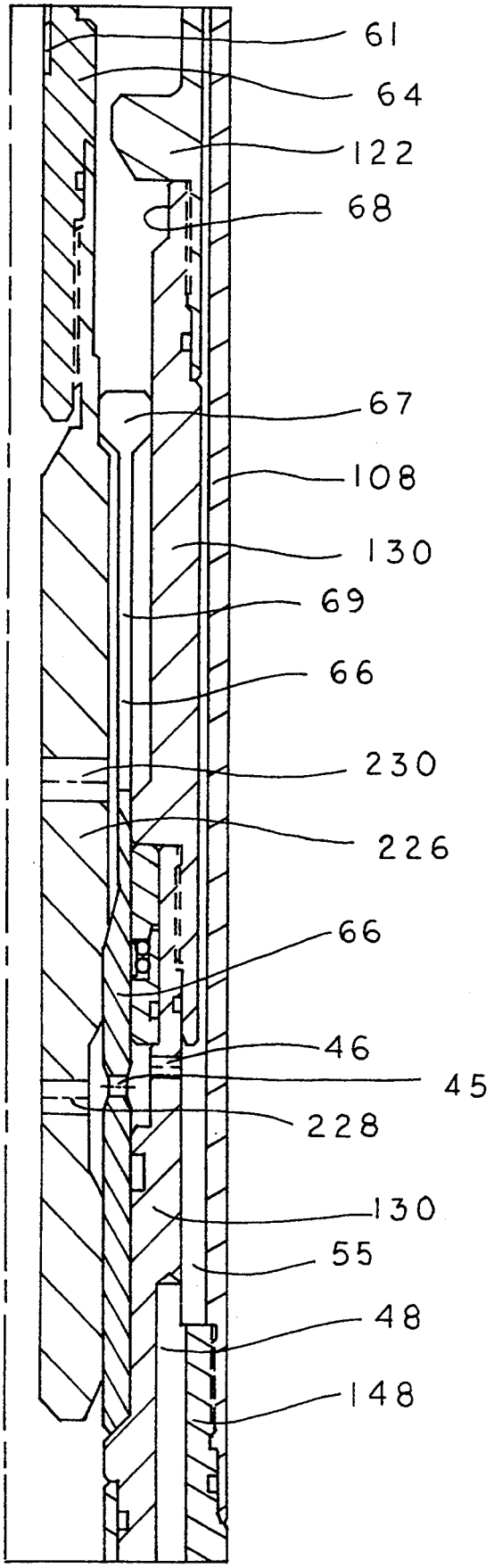
FIG. 6 is a one-quarter longitudinal section view of a portion of the resettable wellbore tool of the present invention, depicting the inflatable bridge plug and a coiled tubing deflation tool in position for deflating the inflatable bridge plug of the present invention.

Referring to FIG. 6, a one-quarter longitudinal section view is depicted of a portion of inflatable bridge plug 26, with coiled tubing deflation tool 226 in position for deflating bridge plug 26. Deflation tool 226 is provided to engage pressurization valve sleeve 66 to both transmit force from coiled tubing 61 to sleeve 66, and provide a fluid communication path between coiled tubing 61 and flow ports 45. Deflation tool 226 includes flow ports 228 to provide fluid communication with flow ports 45 and the interior of coiled tubing 61. Deflation tool 226 further includes flow ports 230 which provide pressure equalization between the interior of pressurization valve sleeve 66 and the exterior of the upper portion of deflation tool 226 to the interior of deflation tool 226 and coiled tubing 61. Deflation tool 226 may be used for deflating inflatable packer 42 and locking hydraulic lock 36 to lock release latch 24 for securing bridge plug 26 to workstring 16.

Operation of resettable wellbore tool 23 for setting inflatable bridge plug 26 within casing 4 is initiated after lowering tool string 2 within wellbore 6 as shown in FIG. 1. Referring again to FIG. 1, once seal cups 20 of well treatment tool 18 need replacement, or other repairs are required for well treatment tool 18, inflatable bridge plug 26 may be set within casing 4 to prevent fluid within casing 4 above perforations 14 from passing through perforations 14 and into lower formation 10.

With reference to FIGS. 3*a* and 3*b*, bridge plug 26 is set within casing 4 by first lowering coiled tubing 61 within workstring 16, through well treatment tool 18 (not shown in FIGS. 3*a* and 3*b*), and to resettable wellbore tool 23, which includes release latch 24 and inflatable bridge plug 26. Inflation tool 62 is positioned on the end of coiled tubing 61 and engages with pressurization valve sleeve 66. Prior to lowering of coiled tubing 61 and inflation tool 62, pressurization valve sleeve 66 is maintained in a closed position for sealing against fluid flow through inflation ports 46 by valve latch member 67 engaging within valve latch profile 68.

Coiled tubing 61 and inflation tool 62 may be moved downward, after engagement with pressurization valve sleeve 66, to move pressurization valve 38 to an open position in which flow ports 45 are aligned with and in fluid communication with inflation ports 46. With pressurization valve 38 in an open position, fluid may flow from the interior of coiled tubing 61, through fluid ports 45 and inflation ports 46, and into pressurization fluid flowpath 48.

Pressurized fluid passing through coiled tubing 61 and into pressurization fluid flowpath 48 urges ported annular piston 52 downward against bias spring 180 once a predetermined amount of fluid pressure is applied through the pressurized fluid and to deflation valve 40. This predetermined amount of fluid pressure required for actuation of deflation valve 40 is determined, at least in part, by the pressure of fluid in annulus 60, and the upward bias force supplied by bias spring 180.

With reference to FIGS. 5*a* through 5*i*, pressurized fluid within pressurization fluid flowpath 48 is applied to deflation valve 40. Ported annular piston 52 is urged downward to align upper flow ports 162 and lower flow ports 164 with flow groove 167 to provide fluid communication between pressurization fluid flowpath 48 and packer fluid flowpath 54. Further, downward movement of ported annular piston 52 seals flow through deflation ports 56. Pressurized fluid may then be passed from coiled tubing 61 through inflation tool 62, flow ports 45, inflation ports 46, fluid flowpath 48, upper flow ports 162, flow groove 167, lower flow ports 164, packer fluid flowpath 54, and into inflation chamber 200. After a second predetermined pressure level is obtained within inflation chamber 200, inflatable element 190 is expanded to urge packing sleeve 192 into setting engagement with wellbore surface 30, which in the preferred embodiment of the present invention is a sealing and gripping engagement with casing 4 (not shown in FIGS. 5*a* through 5*i*).

Still referring to FIGS. 5*a* through 5*i*, the second predetermined amount of fluid pressure level is applied from the upper portion of fluid flowpath 48, through flow ports 112, and into expandable chamber 114 to unlock hydraulic lock 36. This second predetermined amount of pressure level urges sleeve piston 98 downward against an upward force exerted by both bias spring 100 and a fluid pressure level within a central bore of bridge plug 26. It should be noted that bias spring 100 should be selected so that once bias spring 100 is preloaded by adjustable preload sleeve 102, an upwards force will be applied to spring biased annular piston 50 that is adequate to prevent unlocking of hydraulic lock 36 until inflatable packer 42 is urged into setting engagement within casing 4 (not shown in FIGS. 5*a* through 5*i*).

Still referring to FIGS. 5*a* through 5*i*, once expandable chamber 114 has been expanded by filling with pressurized fluid to urge sleeve piston 98 downward, lock sleeve 96, which is also urged downward with sleeve piston 98, is removed from between locking dogs 70 and lock housing 88. Pressurization valve 38 is then closed by moving pressurization valve sleeve 66 upwards into a closed position to again seal against flow through inflation ports 46 in order to retain the second predetermined amount of pressure level within fluid flowpath 55, which in the preferred embodiment of the present invention includes fluid flowpath 48, packer fluid flowpath 54, inflation chamber 200, and expandable chamber 114.

Once returned to the closed position, pressurization valve sleeve 66 is latched again into the closed position, which in the preferred embodiment of the present invention is also the latched closed position, locking fluid pressure within fluid flowpath 55. Pressurization valve sleeve 66 is latched into the closed position by valve latch member 67 again latching within valve latch profile 68. Coiled tubing 61 may then be withdrawn from wellbore 6 (not shown in FIGS. 5*a* through 5*i*).

An upward force may then be applied to workstring 16 for separation of release latch 24. Release latch 24 is separated in the preferred embodiment of the present invention when 10,000 pounds of force is upwardly applied to workstring 16 as inflatable packer 42 is maintained in setting engagement for gripping and sealing within casing 4.

Still referring to FIGS. 5*a* through 5*i*, with lock sleeve 96 moved downward from between locking dogs 70 and lock housing 88, an upward force applied to lower latch sleeve 86 will urge locking dogs 70 radially outward against the inward pulling force of garter springs 94. With locking dogs 70 free to move radially outward, ratchet latch 34 may then be separated by collet fingers 78 flexing radially inward and away from mating ratchet teeth on the interior of the upper portion of anchor head 82. Release latch 34 then separates between lower latch sleeve 86 and anchor head 82, with locking dogs 70 remaining secured within anchor head 82.

With reference to FIG. 2, workstring 16 and well treatment tool 18 may then be removed from wellbore 6 as inflatable bridge plug 26 of resettable wellbore tool 23 remains in setting engagement for gripping and sealing wellbore surface 30 to prevent fluid flow within casing 4.

Resecurement of well treatment tool 18 and workstring 16 to inflatable bridge plug 26 is accomplished by lowering workstring 16 to position lower latch sleeve 86 about anchor head 82 as depicted in FIGS. 5*a* through 5*i*. Ratchet teeth on collet fingers 78 will reengage with mating ratchet teeth on the upper portion of anchor head 82 and locking dogs 70 will radially expand and snap back into position within recess 93 in the lower portion of lower latch sleeve 86. Garter springs 94 will urge locking dogs 70 radially inward for engagement back into recess 93.

Figure 4A:
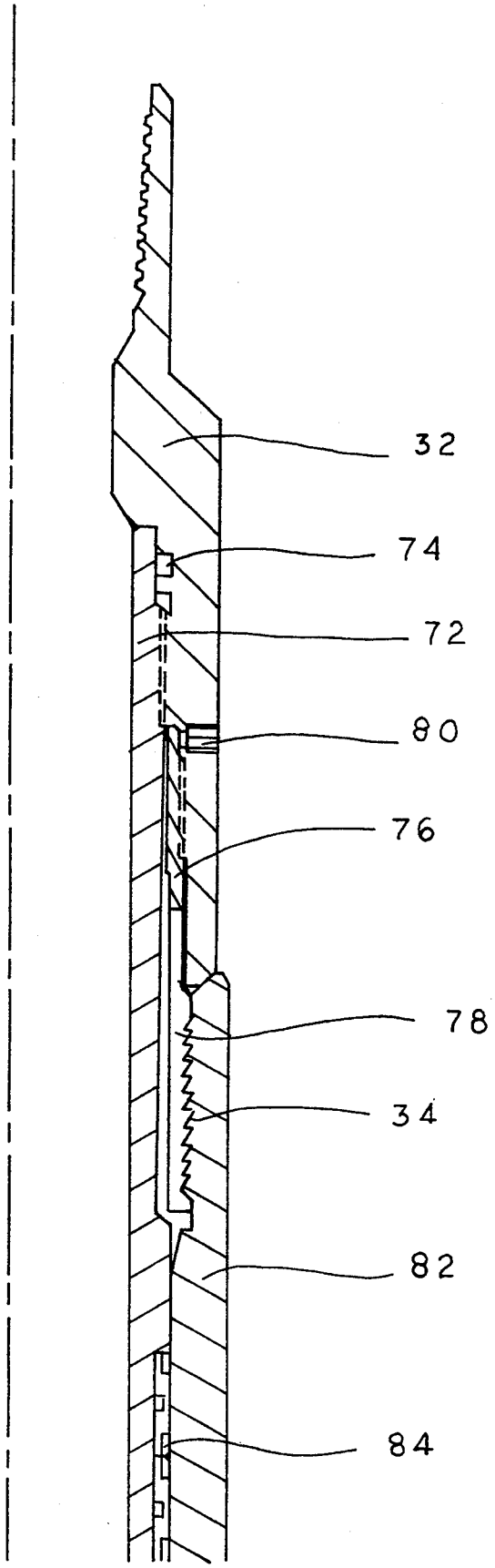
FIGS. 4*a* through 4*i* are one-quarter longitudinal section views which, when read together, depict the resettable wellbore tool of the present invention, showing the inflatable bridge plug in a deflated position prior to initiating inflation and release from the workstring.
Figure 4B:
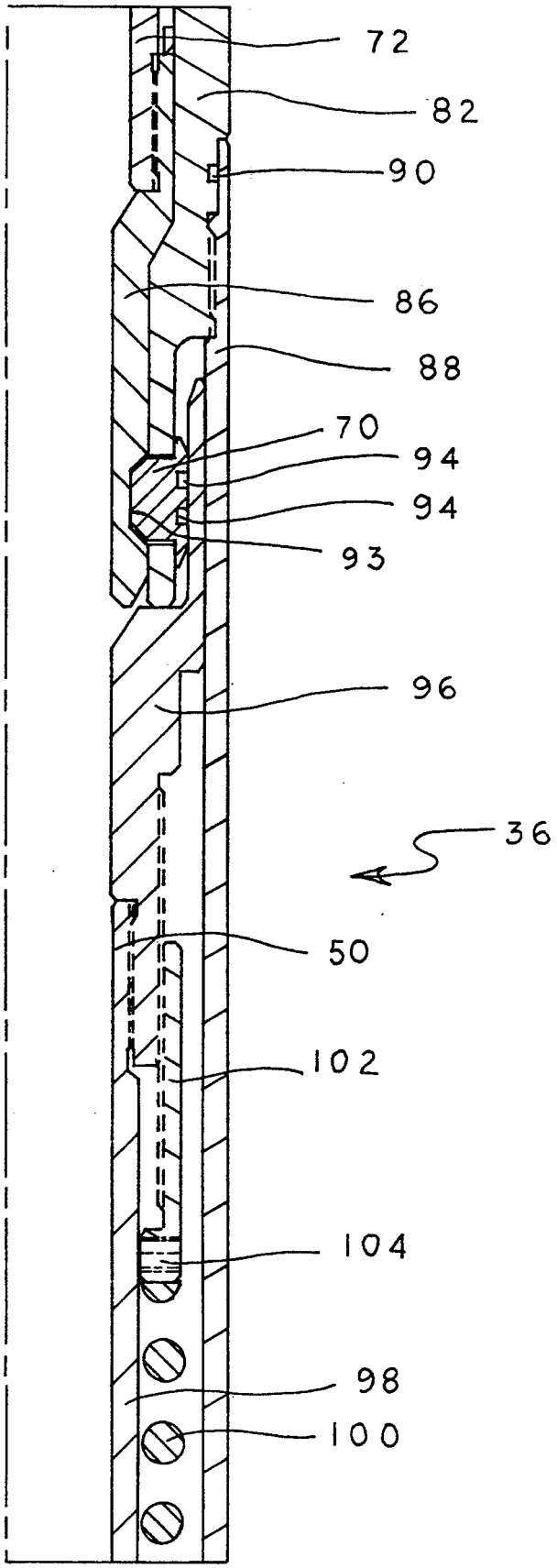
Figure 4C:
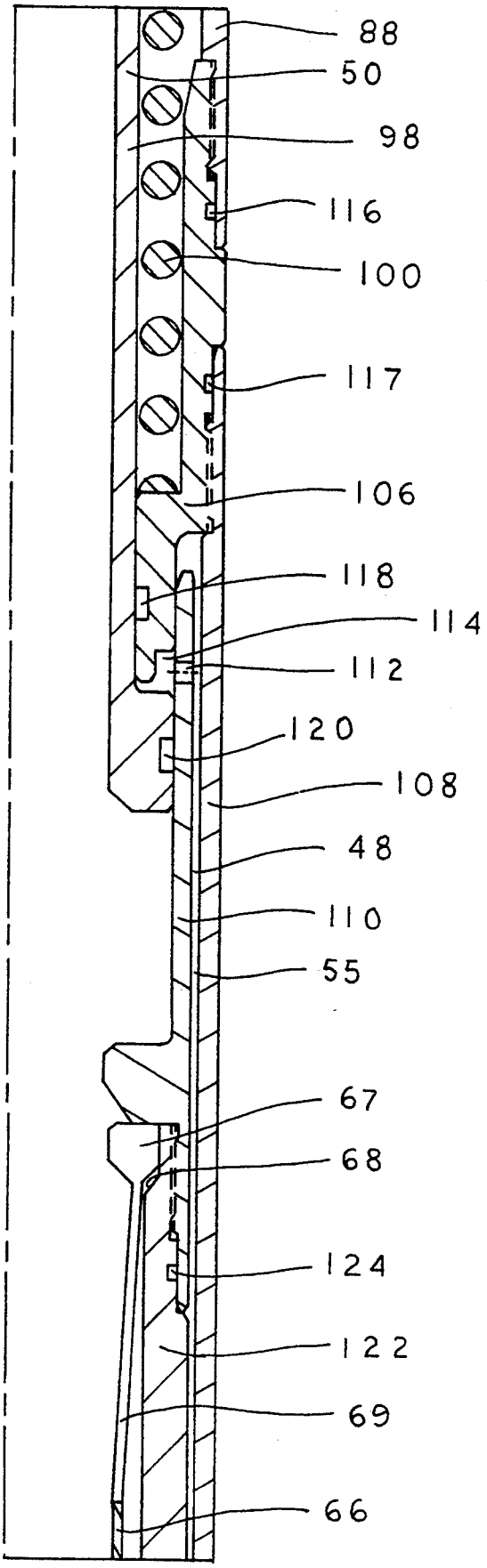
Figure 4D:
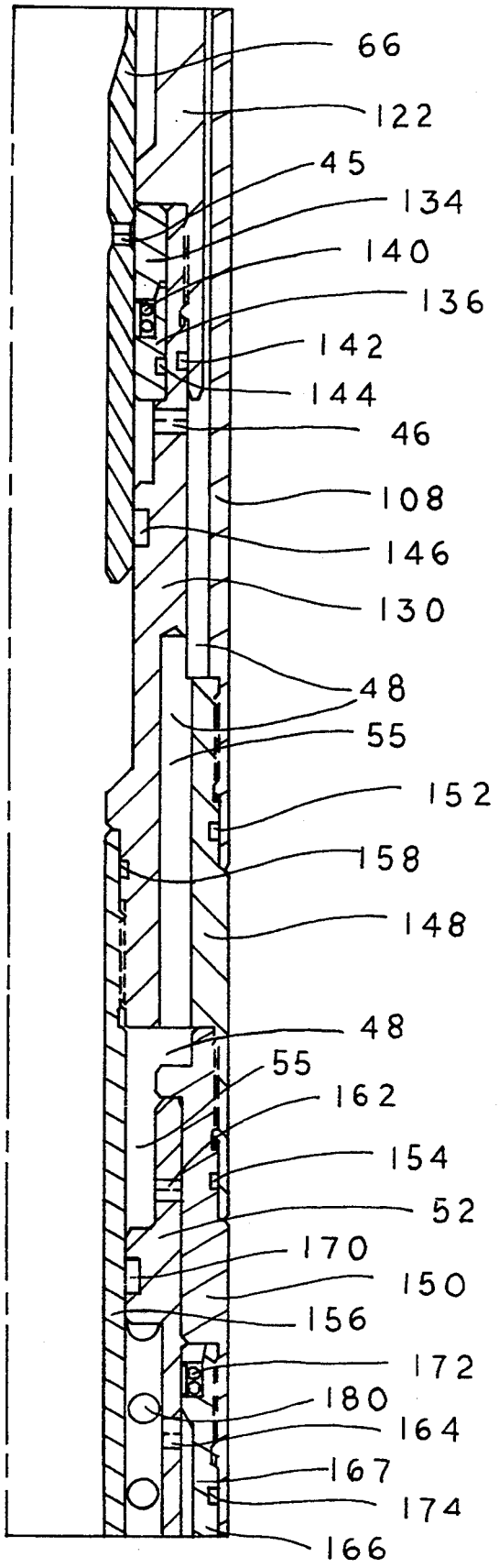
Figure 4E:
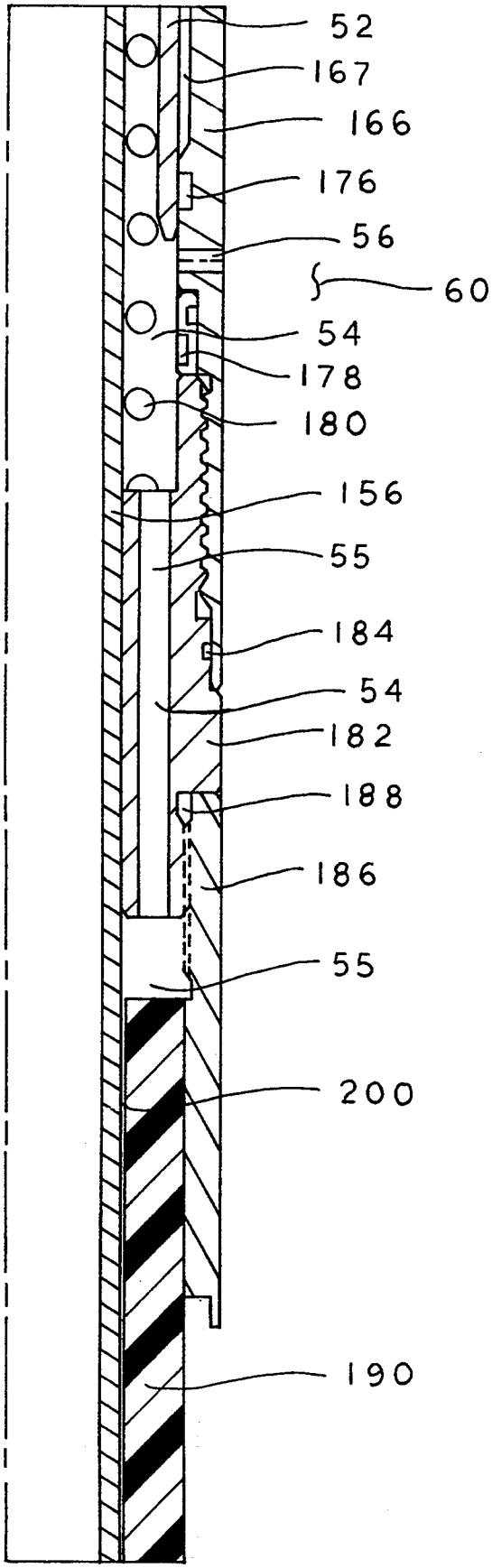
Figure 4F:
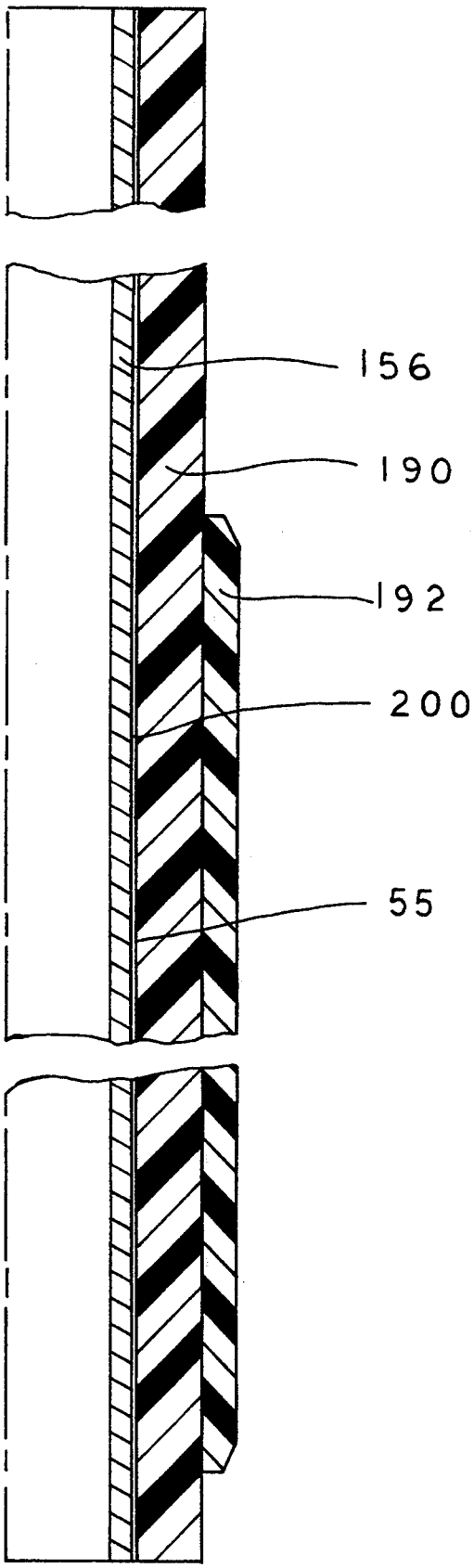
Figure 4G:
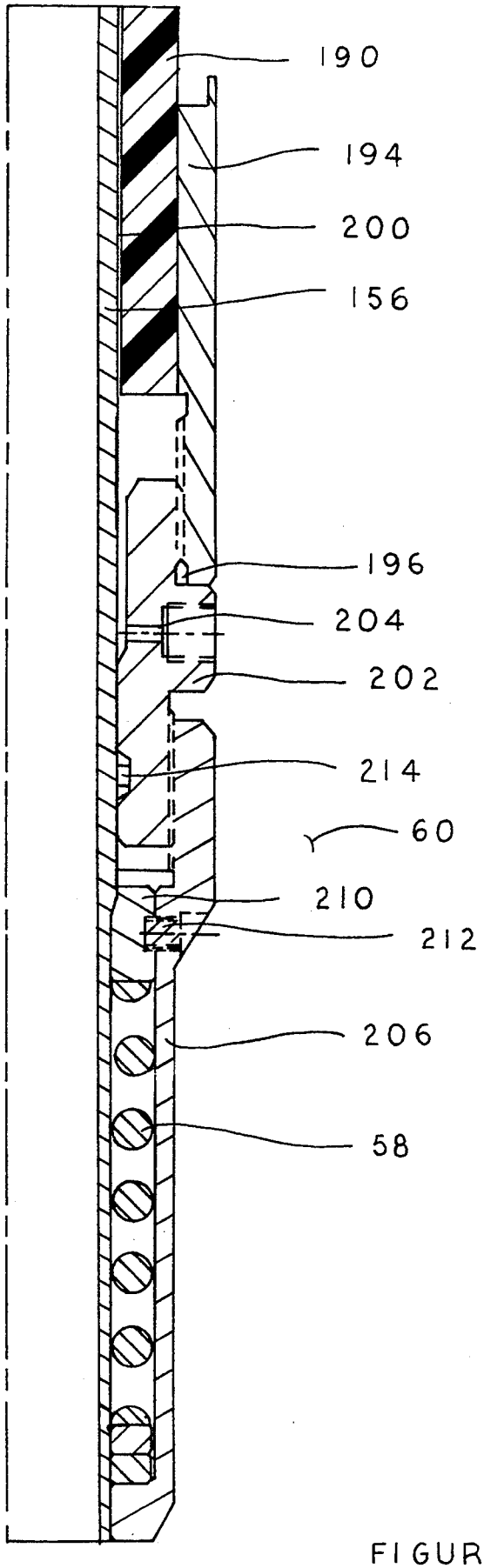
Figure 4H:
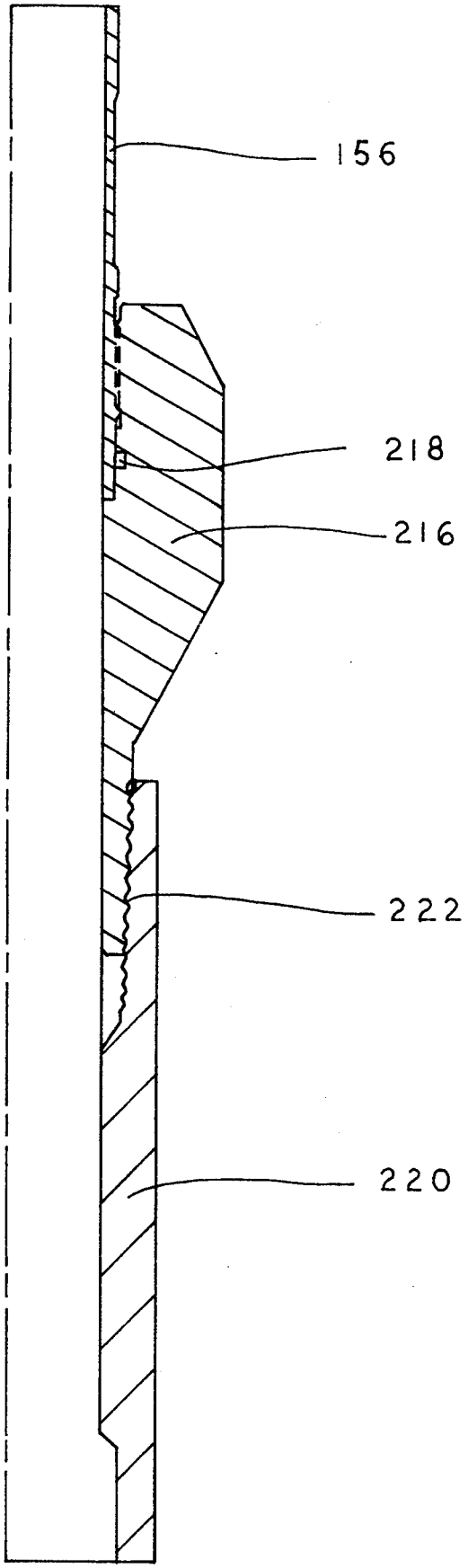
Figure 4I:
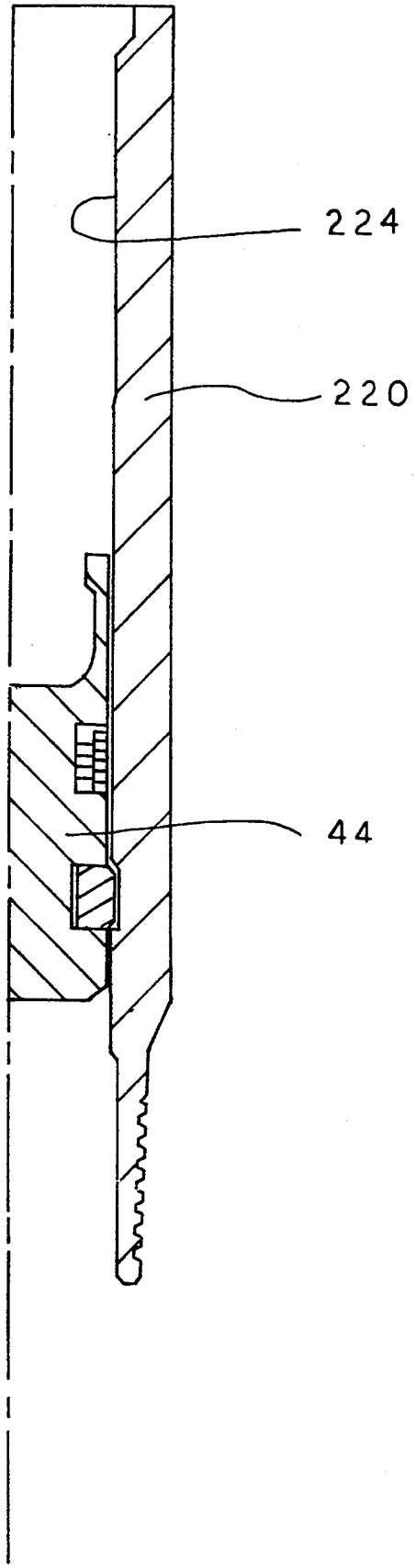
Figure 5A:
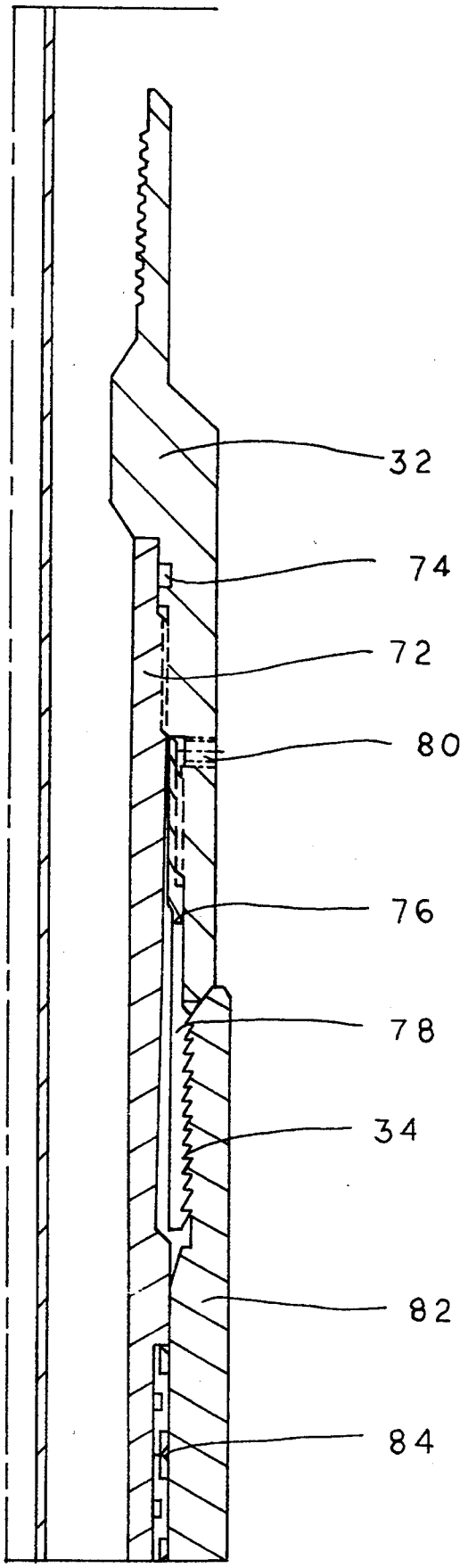
FIGS. 5*a* through 5*i* are one-quarter longitudinal section views which, when read together, depict the resettable wellbore tool of the present invention which includes a release latch, an inflatable bridge plug, and a coiled tubing inflation tool, with the inflatable bridge plug shown in an inflated position and the release latch shown hydraulically unlocked for allowing release of the inflatable bridge plug from the lower end of the workstring.
Figure 5B:
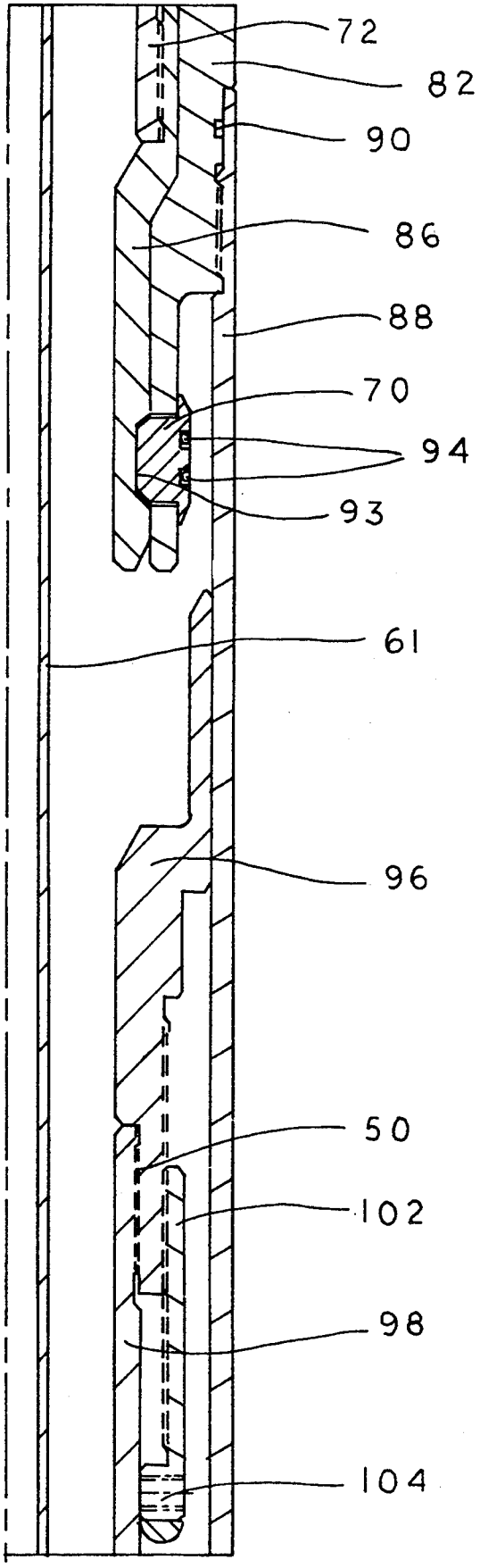
Figure 5C:
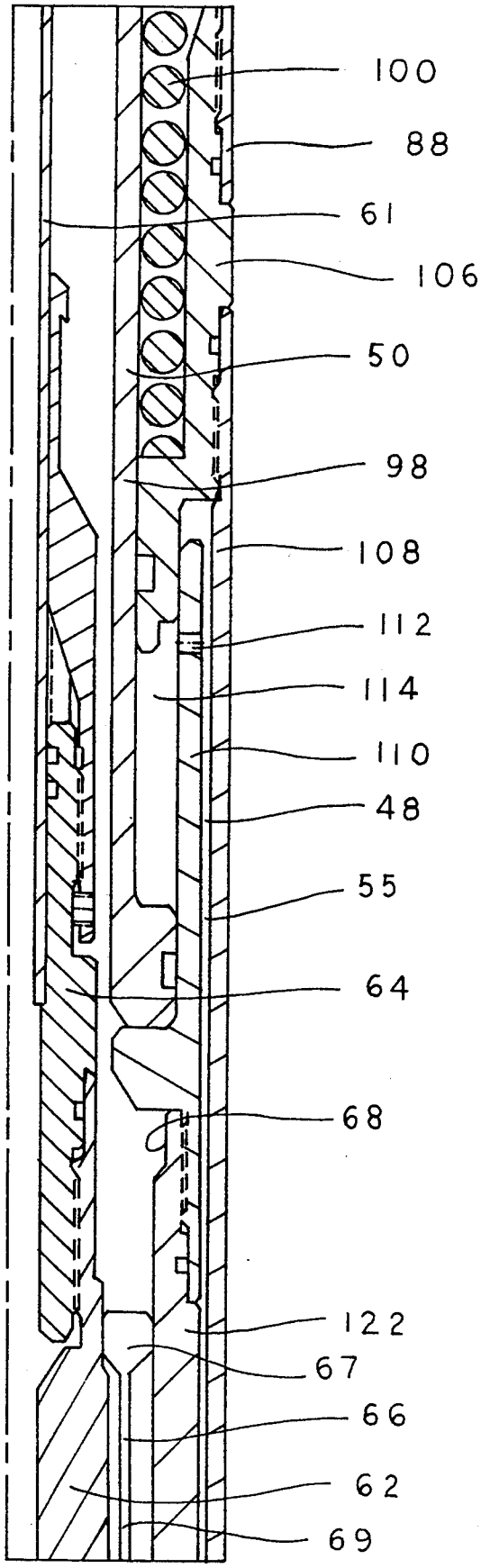
Figure 5D:
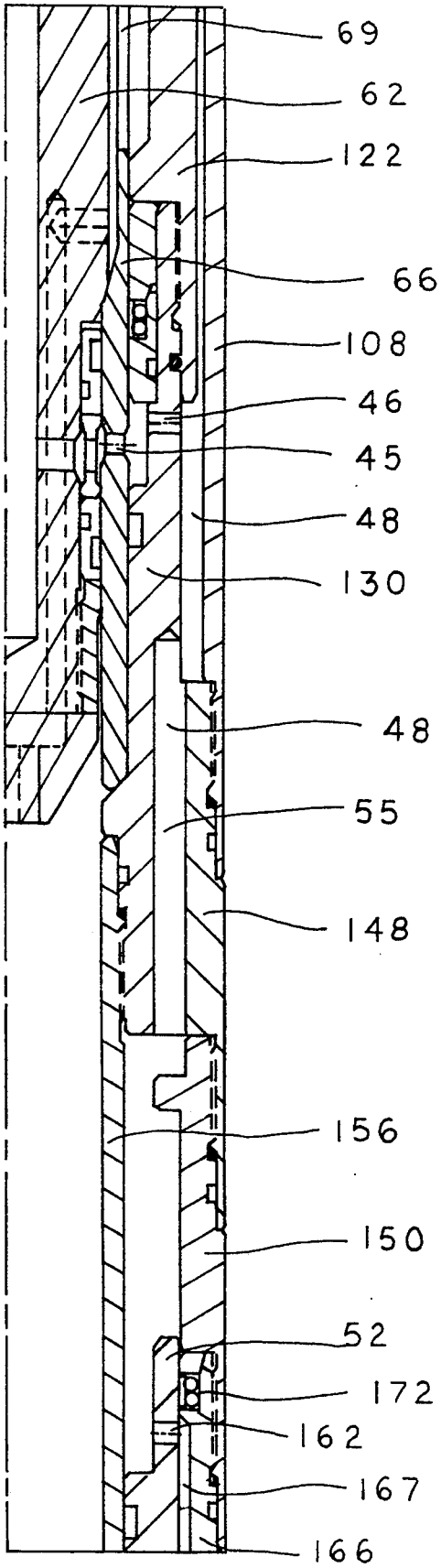
Figure 5E:
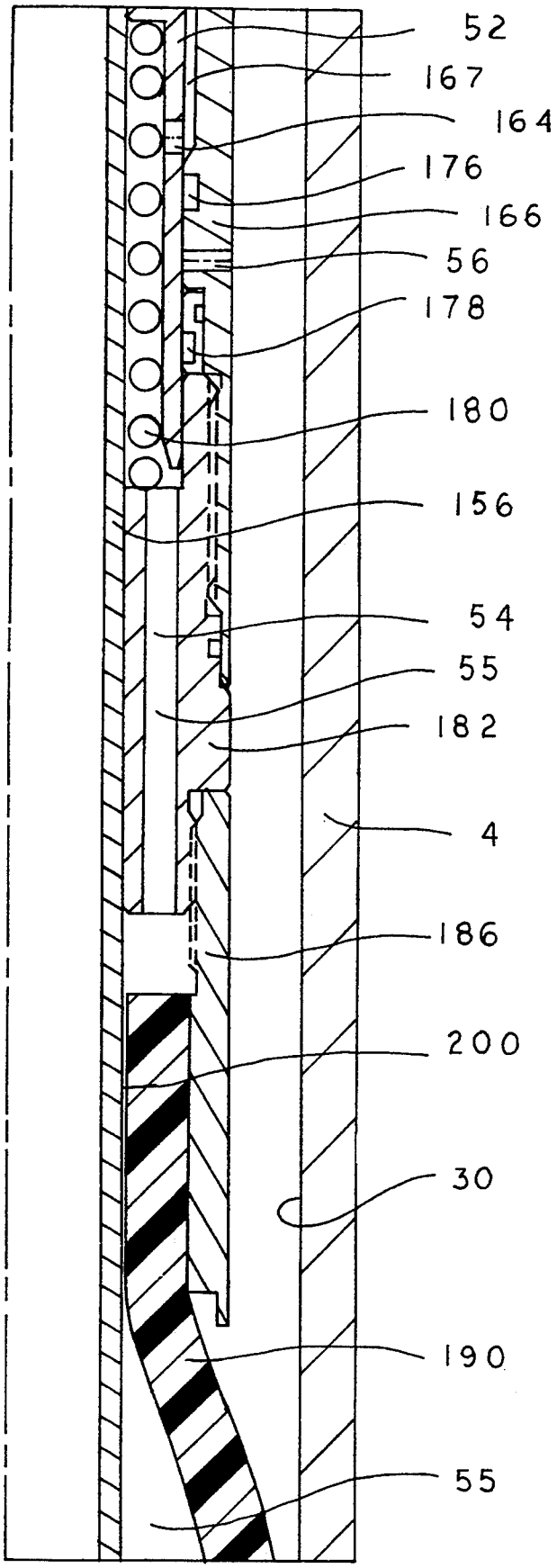
Figure 5F:
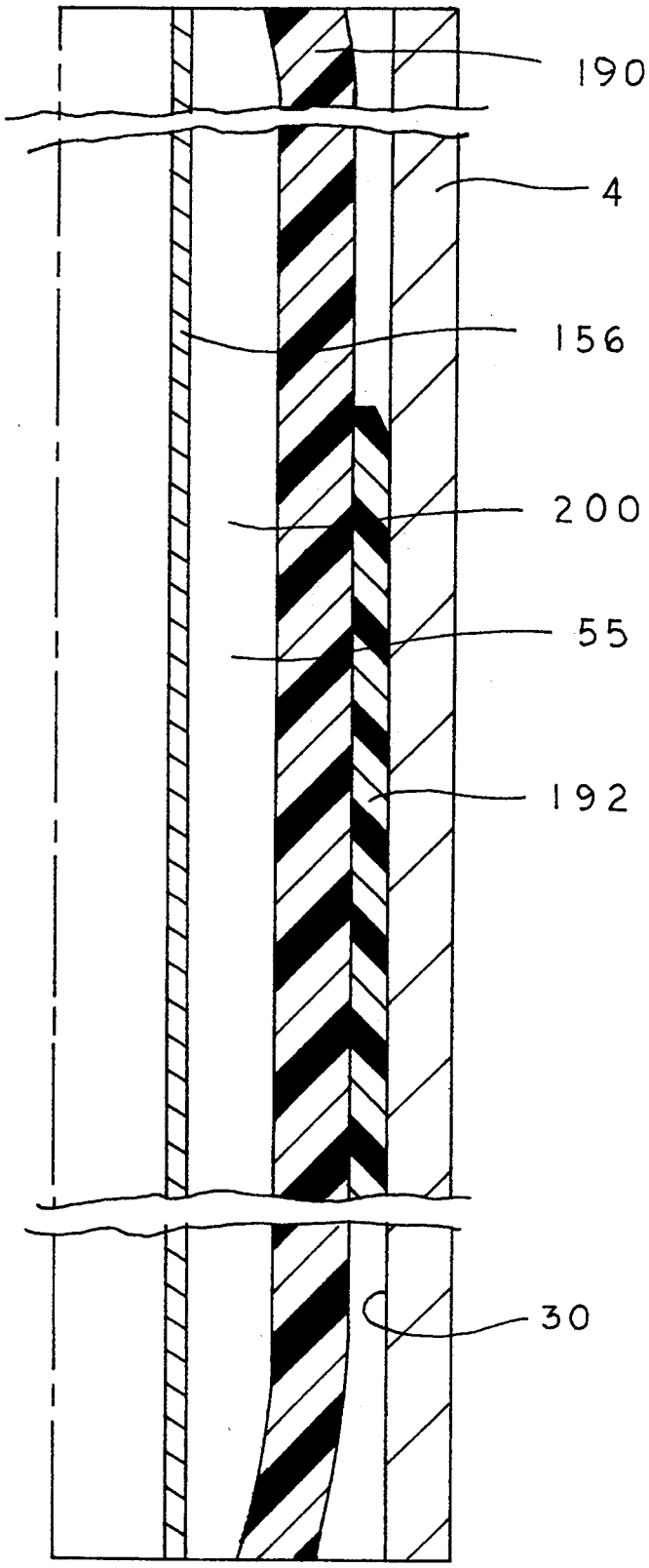
Figure 5G:
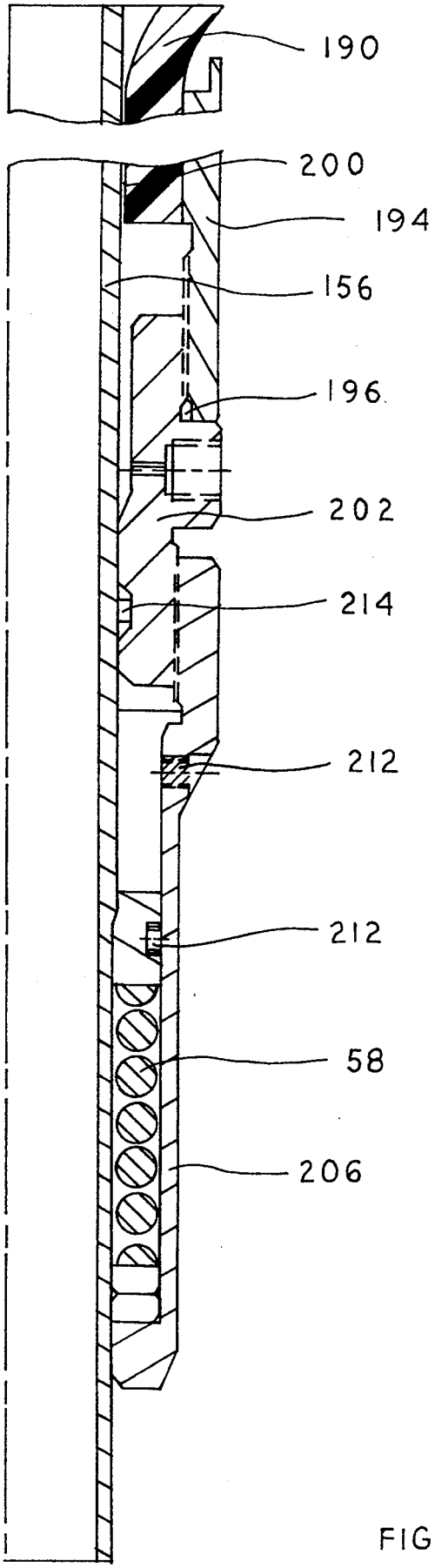
Figure 5H:
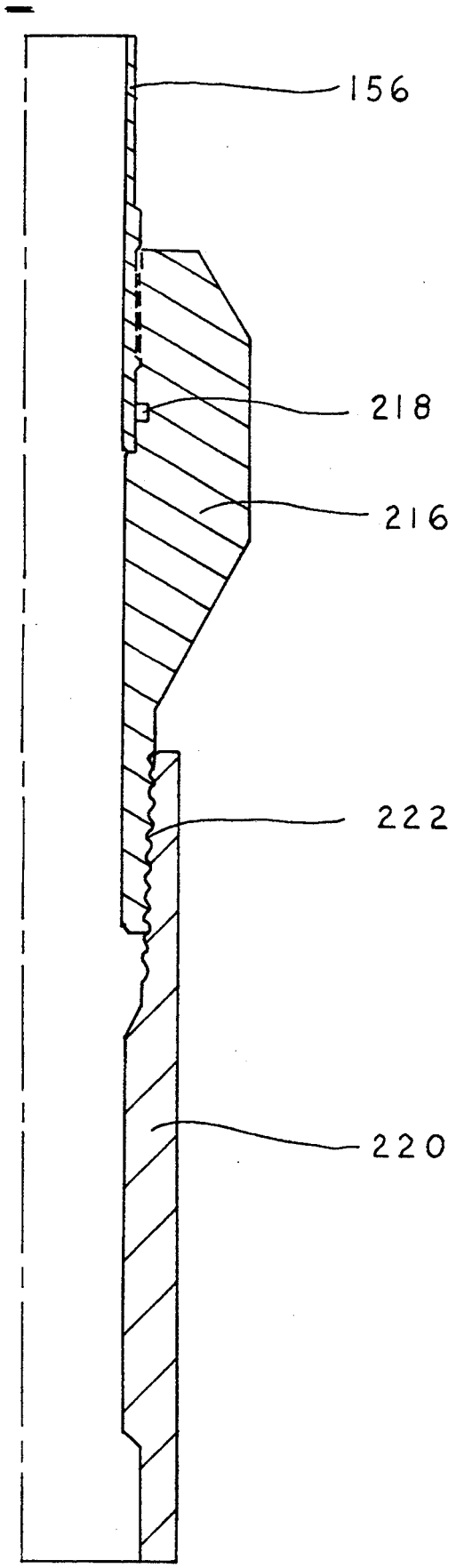
Figure 5I:
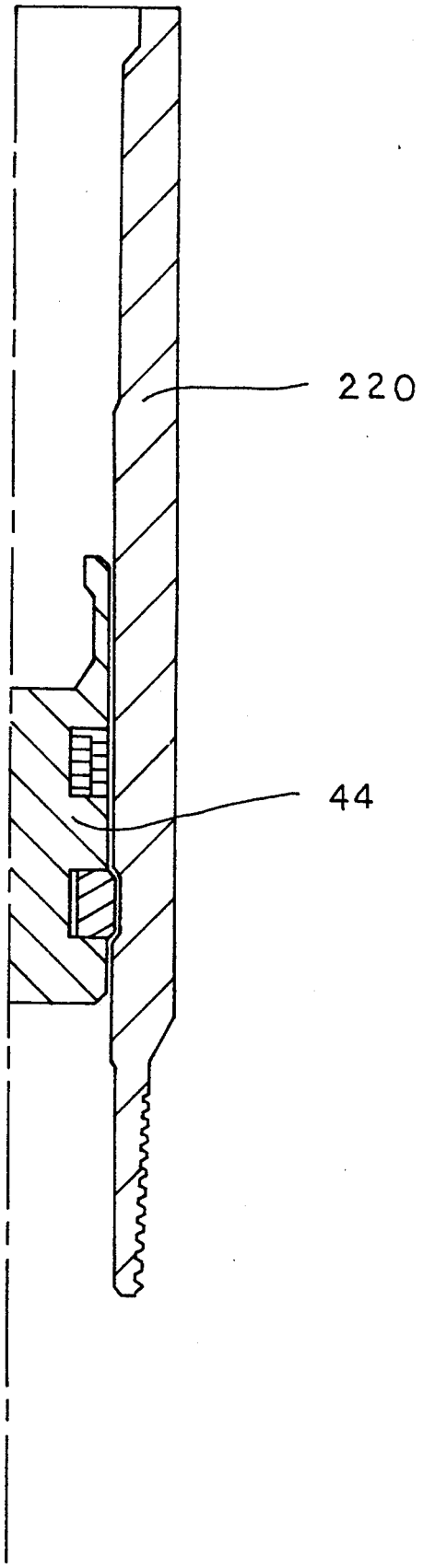

With reference to FIG. 6, coiled tubing 61 may then be lowered back through workstring 16 and into wellbore 6 to position deflation tool 226 interiorly of pressurization valve sleeve 66 for opening pressurization valve 38 by urging valve sleeve 66 downward and into an open position as shown in FIG. 6. Fluid communication is then provided between the interior of coiled tubing 61, the interior of bridge plug 26, flow ports 45, inflation ports 46, and pressurization fluid flowpath 48. As fluid pressure is bled off from fluid flowpath 55, as shown in FIG. 6, ported annular piston 52 and spring biased annular piston 50 will move back to their initial positions as shown in FIGS. 4*a* and 4*i*. First, hydraulic lock 36 will lock as spring biased annular piston 50 and lock sleeve 96 move upward to retain locking dogs 70 in position within recess 93 to lock release latch 24 to prevent ratchet latch 34 from separating. Then, after the fluid pressure level is lowered below the first predetermined pressure level, deflation valve 40 will move to a deflation position by ported annular piston 52 being urged upward by bias spring 180 and into the deflation position. In the deflation position, ported annular piston 52 seals against fluid communication between fluid flowpath 48 and packer fluid flowpath 54, and allows fluid communication between packer fluid flowpath 54 and deflation ports 56.

Pressurized fluid within inflation chamber 200 then flows through packer fluid flowpath 54, out deflation ports 56, and into annulus 60 until inflatable packer 42 is fully deflated. While deflation valve 40 is maintained in a deflation position, pressure is equalized between inflation chamber 200 and annulus 60. Additionally, deflation spring 58 urges inflatable packer 42 into a deflated position.

Coiled tubing 61 and deflation tool 226 may then be removed from wellbore 6, and well treatment operations may then be continued. Resettable wellbore tool 23 may later be used by running inflation tool 62 back into wellbore 6 and setting inflatable bridge plug 26 in setting engagement with wellbore surface 30 for preventing fluid flow within casing 4, and release latch 24 may again be operated to uncouple workstring 16 from bridge plug 26.

Figure 7:
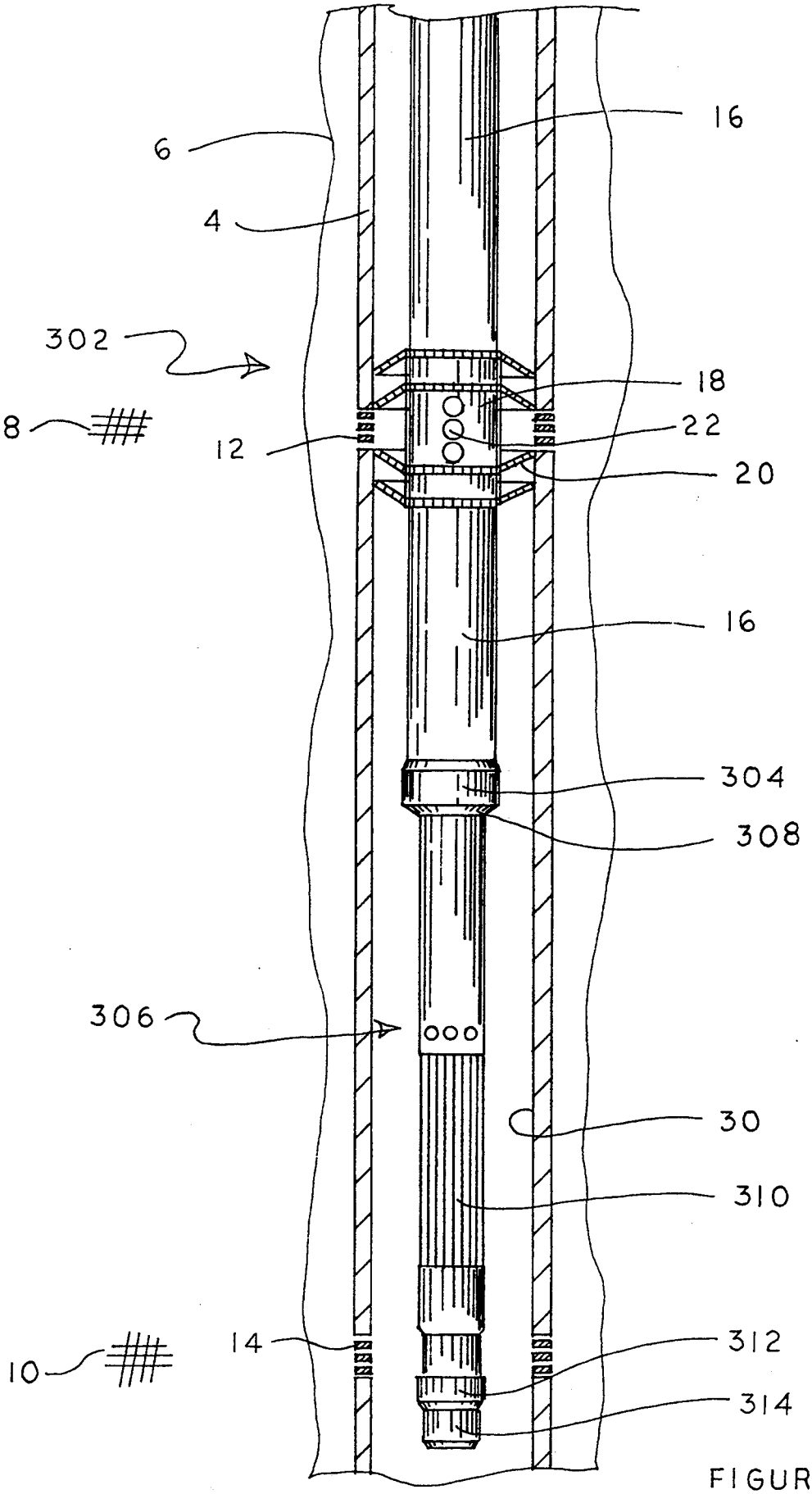
FIG. 7 is a perspective view of an alternative wellbore tool string which includes the well treatment tool of FIG. 1, and an alternative resettable wellbore tool of the present invention having an inflatable bridge plug which is shown in a deflated position secured to the lower end of a workstring.

Referring now to FIG. 7, a perspective view depicts an alternative embodiment of the present invention which is included in alternative wellbore tool string 302. Alternative wellbore tool string 302 includes workstring 16 and well treatment tool 18 of FIG. 1, and a workstring head adapter 304 which secures and an alternative resettable wellbore tool 306 to workstring 16 and well treatment tool 18.

Alternative resettable wellbore tool 306 includes release latch 308 and inflatable bridge plug 310. In FIG. 7, inflatable bridge plug 310 is depicted in a deflated position secured to the lower end of a workstring 16 and well treatment tool 18. Inflatable bridge plug 310 includes gauge ring 312 and landing nipple 314.

The design details for resettable wellbore tool 306 are similar to the design details depicted for resettable wellbore tool 23 in FIGS. 4*a* through 4*i*, FIGS. 5*a* through 5*i*, and FIG. 6. Inflatable bridge plug 310 includes release latch 308 having a hydraulic lock, as does release latch 24 of the preferred embodiment of the present invention. Inflatable bridge plug 310 further includes a fluid control member having a pressurization valve, which may be locked into a closed position, and a deflation valve, similar to deflation valve 40 discussed above.

The primary difference between resettable wellbore tool 306 and resettable wellbore tool 23 is that resettable wellbore tool 306 is smaller than resettable wellbore tool 23 to accommodate passage through the central bore of a smaller tubing string than resettable wellbore tool 23 can be run through. Further, referring to FIGS. 4*a* and 5*a*, head adapter 32, which is shown for use with resettable wellbore tool 23, would be replaced by workstring head adapter 304 for securing resettable wellbore tool 306 to workstring 16, as depicted in FIGS. 7 and 8, and coiled tubing head adapter 322 for securing resettable wellbore tool 306 to coiled tubing string 320, as discussed below in reference to FIGS. 8 and 9.

Similar to the operations discussed above for resettable wellbore tool 23, resettable wellbore tool 306 may be operated to inflate and deflate inflatable bridge plug 310 for a selective setting engagement with wellbore surface 30 by running a coiled tubing string and an inflation tool (not shown in FIG. 7) through workstring 16 and well treatment tool 18 to engage with resettable wellbore tool 306. Resettable wellbore tool 306 is operable as described above for resettable wellbore tool 23. Resettable wellbore tool 306 may be coupled to coiled tubing string 320 for either moving to and resetting at a different depth within wellbore 6, or for removal from wellbore 6 by passing through workstring 16, or production tubing string 316, which is shown in FIGS. 9 and 10.

Figure 8:
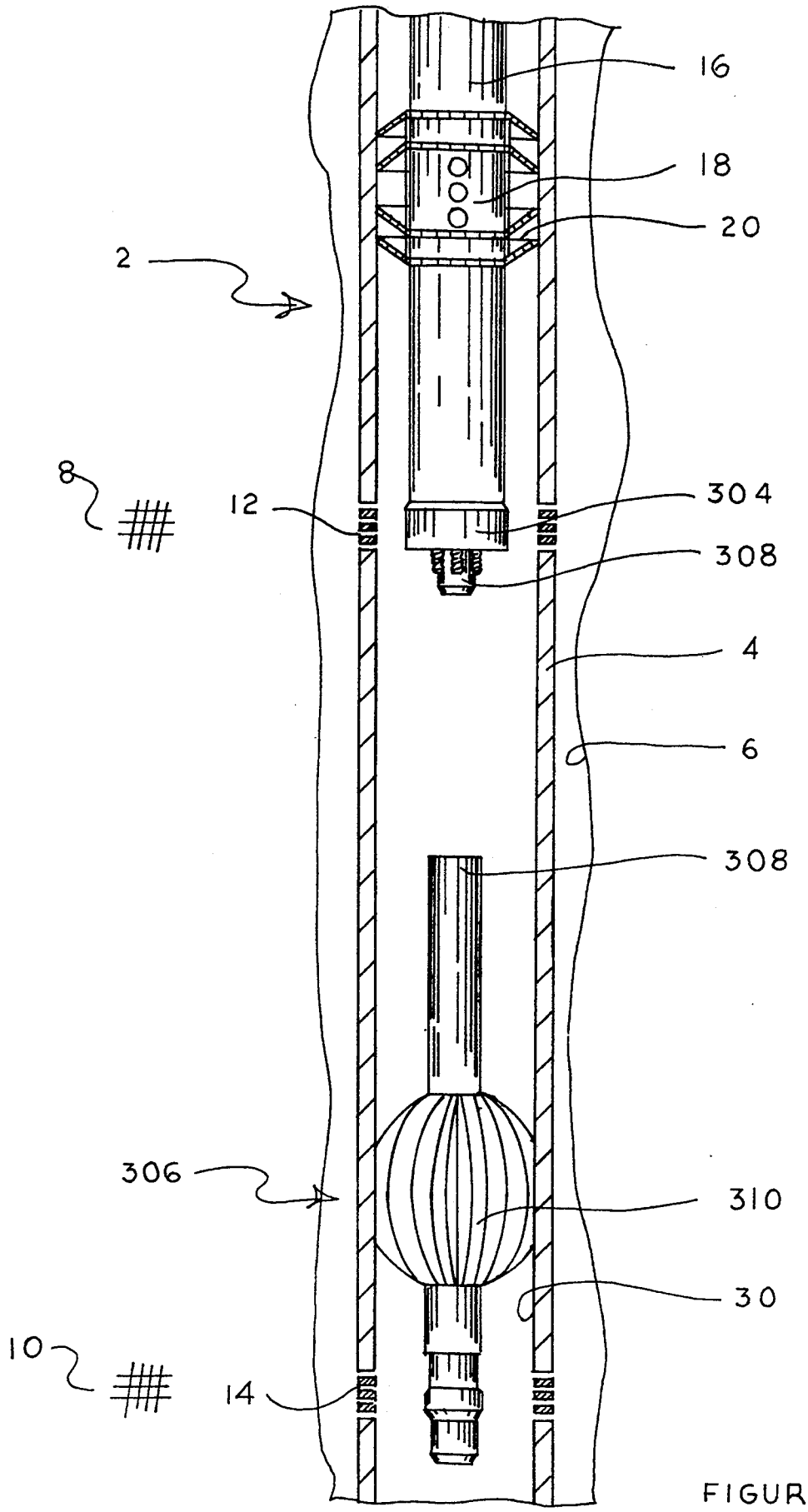
FIG. 8 is a perspective view of the wellbore tool string of FIG. 7, showing the inflatable bridge plug of an alternative embodiment of the present invention after release from the workstring, in an inflated position in gripping and sealing engagement with the wellbore surface.

With reference to FIG. 8, a perspective view of wellbore tool string 302 of FIG. 7 depicts inflatable bridge plug 310 after separation of release latch 308 to release inflatable bridge plug 310 from workstring 16 and well treatment tool 18. Inflatable bridge plug 310 is depicted after having been inflated and urged to sealingly engage casing 4 to prevent fluid flow between lower formation 10, and both upper formation 8 and the interior of casing 4 above inflatable bridge plug 310. It should be noted however, that inflatable bridge plug 310 may be left in setting engagement, and a retrievable plug (not shown in FIG. 8) removed from and later reinserted into landing nipple 314 to selectively allow fluid flow through inflatable bridge plug 310, just as retrievable plug 44 may be retrieved from and later latched back into landing nipple 29.

Prior to release from workstring 16, inflatable bridge plug 310 is urged into an inflated position in a setting engagement which, in this alternative embodiment of the present invention, is a gripping and sealing engagement with wellbore surface 30. After inflatable bridge plug 310 is urged into setting engagement with wellbore surface 30, release latch 308 is unlocked and then separated to release inflatable bridge plug 310 from workstring 16 and well treatment tool 18.

Figure 9:
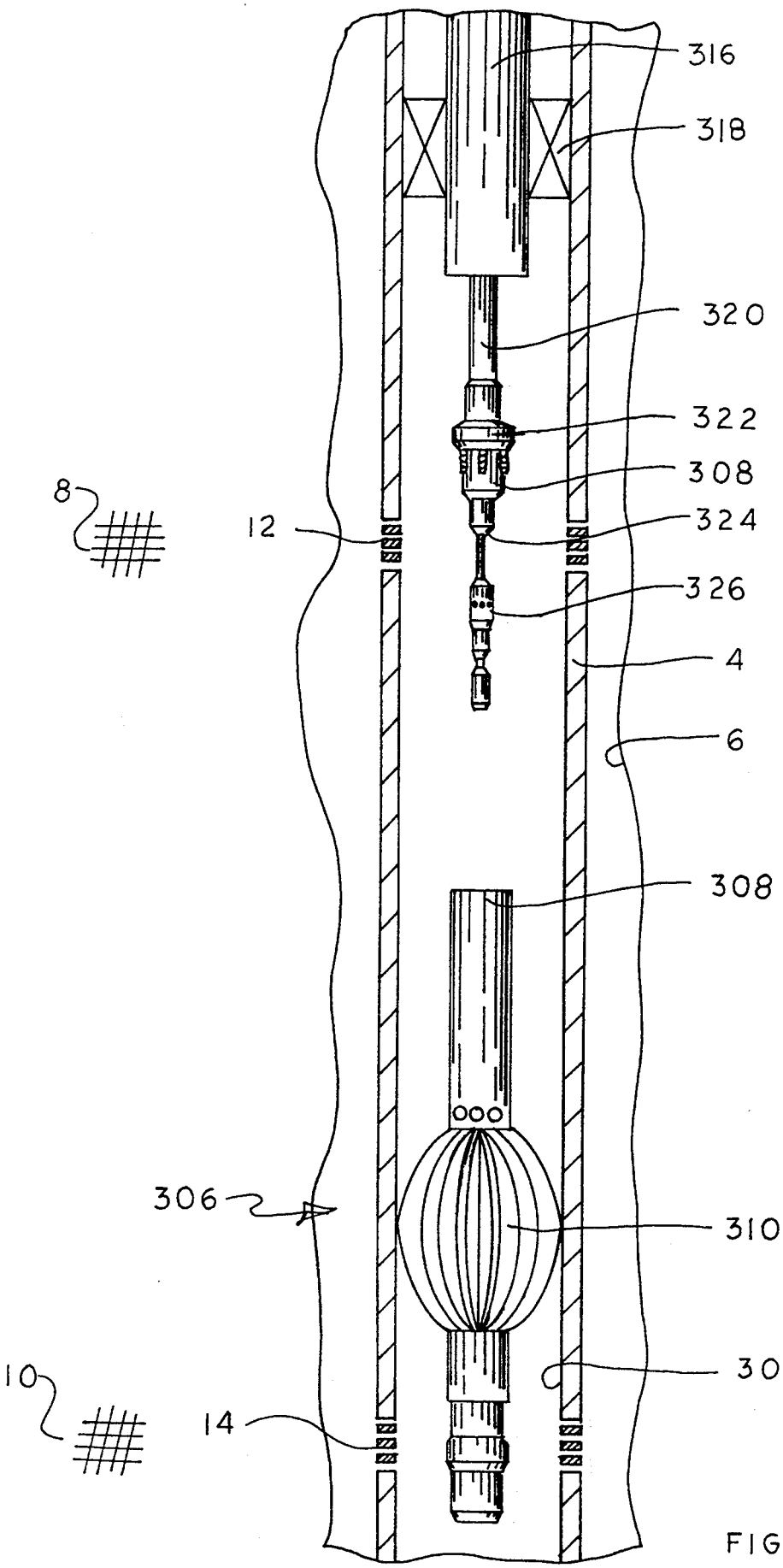
FIG. 9 is a perspective view of the wellbore of FIGS. 1, 2, 7, and 8, showing a production tubing string and an alternative resettable wellbore tool of the present invention, showing the inflatable bride plug in the inflated position of FIG. 8 and a retrieval tool which is depicted secured to the lower end of a coiled tubing string.
Figure 10:
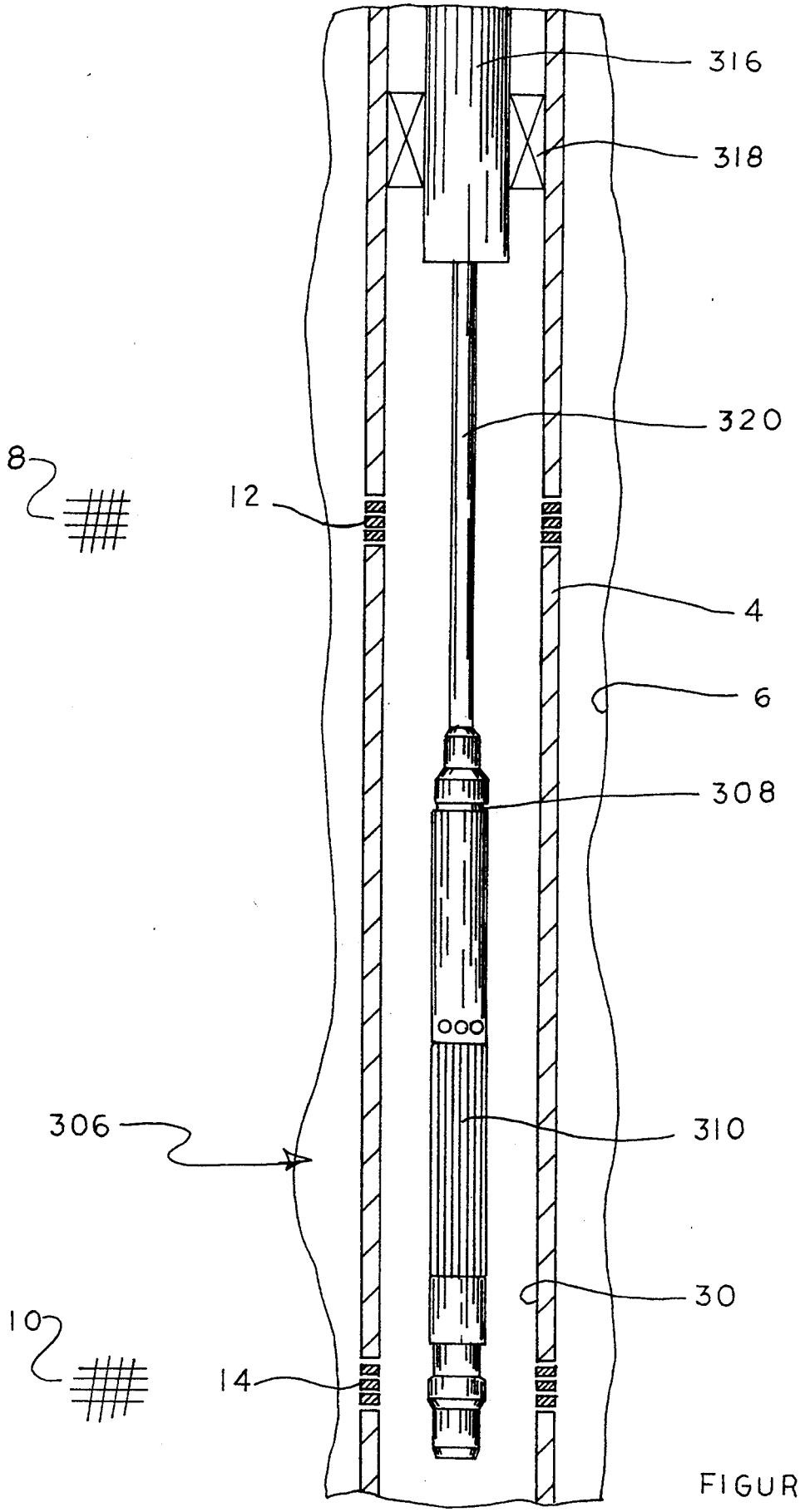
FIG. 10 is a perspective view of the wellbore of FIG. 9, showing an alternative resettable wellbore tool of the present invention releasably secured to the coiled tubing string and the inflatable bridge plug returned to a deflated position ready for either retrieval from the wellbore, or resetting into setting engagement with the wellbore surface at another depth within the wellbore.

Referring now to FIG. 9, a perspective view of the wellbore 6 of FIGS. 1, 2, 7, and 8 depicts production tubing string 316, production packer 318, and resettable wellbore tool 306 set within wellbore 6. Resettable wellbore tool 306 is depicted after being set within wellbore 6 in setting engagement with wellbore surface 30. In this alternative embodiment of the present invention, production tubing 316 may be similar size to workstring 16 (not shown in FIG. 9), and could possibly be the same tubing used for workstring 16 (not shown in FIG. 9).

Resettable wellbore tool 306, as depicted in FIG. 9, may have been run into wellbore 6, and released from workstring 16 and well treatment tool 18 to prevent fluid flow within wellbore 6 during completion operations to ready wellbore 6 for production, such as operations to set production packer 318 and production tubing 316. Additionally, resettable wellbore tool 306 may have been run through production tubing 316 and into wellbore 6 on coiled tubing string 320, then urged into setting engagement with wellbore surface 30 and released from coiled tubing 316.

Coiled tubing head adapter 322 secures retrieval tool 324 to the lower end of coiled tubing string 320. Retrieval tool 324 includes an upper portion of release latch 308 and deflation tool 326. Deflation tool 326 is similar to deflation tool 226 (not shown in FIG. 9), and engages within resettable wellbore tool 306 to deflate inflatable bridge plug 310, which in the preferred embodiment of the present invention, relatches and hydraulically locks release latch 306.

FIG. 10 is a perspective view depicting resettable wellbore tool 306 of the present invention releasably resecured to coiled tubing string 320, and inflatable bridge plug 310 returned to a deflated position ready for retrieval from wellbore 6 through production tubing 316. In other embodiments of the present invention, resettable wellbore tool 306 may instead be repositioned within wellbore 6, and inflatable bridge plug 310 again urged into setting engagement with wellbore surface 30. Further, as with resettable wellbore tool 23, in other embodiments of the present invention, resettable wellbore tool 306 may be lowered within a wellbore, and inflatable bridge plug 310 urged into a setting engagement with a wellbore surface which is not an interior surface of a wellbore casing, but may instead be a borehole surface such as the open-hole surface of wellbore 6.

The resettable wellbore tool of the present invention, as depicted by both the preferred embodiment and the above-described alternative embodiment, provides several advantages over prior art wellbore tools. The resettable wellbore tool of the present invention includes a hydraulic lock to prevent uncoupling of a release latch securing an inflatable bridge plug to a workstring until after the inflatable bridge plug has been fully urged into setting engagement within a wellbore casing. Further, the release latch may be relatched for repositioning the inflatable bridge plug, and then later uncoupled for moving of the workstring independently of the inflatable bridge plug.

Additionally, an inflatable bridge plug is provided which may be inflated without requiring mechanical manipulation of a workstring on which it is run into the wellbore, but rather is set by filling with pressurized fluid from a coiled tubing string, which is lowered within the workstring to provide pressurized fluid for inflating the inflatable bridge plug. A pressurization valve is locked in position to prevent premature inflation of the inflatable bridge plug by assuring that pressurized fluid within the workstring will not be applied to the inflatable bridge plug to prevent inadvertent inflation.

Deflation of the inflatable bridge plug is facilitated by a deflation valve which vents and equalizes fluid pressure between an inflation chamber of the inflatable bridge plug and an annulus, the annulus being defined between the exterior of the inflatable bridge plug and the wellbore casing. The deflation valve equalizes fluid pressure between the inflation chamber and the annulus which insures that there is not a positive pressure differential between the inflation chamber and the annulus which would urge inflation of the inflatable bridge plug.

The inflatable bridge plug may be run within a wellbore on a workstring, and then later reset at another depth within the wellbore, or removed through a production tubing string which is set within the wellbore after removal of the workstring.

While the invention has been shown in only one of its forms, in both the preferred embodiment and the alternative embodiment discussed above, it is thus not limited but is susceptible to various changes and modifications without departing from the spirit thereof.

What is claimed is:

1. A resettable wellbore tool for running into a wellbore on a workstring and urging into a setting engagement with a wellbore surface by filling with a pressurized fluid, said resettable wellbore tool comprising:

a source of pressurized fluid for urging said settable wellbore tool into said setting engagement;

an inflatable packer having a mandrel which extends longitudinally within said resettable wellbore tool, an inflatable element which is retained about said mandrel and includes an inflation chamber defined therebetween, and a fluid flowpath which includes said inflation chamber, at least one inflation port for passing said pressurized fluid within said mandrel, and at least one deflation port for passing said pressurized fluid from said fluid flowpath;

a fluid control member having at least one valve member which is repeatably moveable about said at least one inflation port for selectively passing said pressurized fluid through said at least one inflation port for repeatably inflating said inflatable packer, and for controlling flow of said pressurized fluid through said at least one deflation port for deflating said inflatable packer;

a release latch having a latch member which is repeatably moveable between a latched position for securing said inflatable packer to said workstring, and an unlatched position for releasing said inflatable packer from said workstring; and said resettable wellbore tool operable for resecuring said inflatable packer to said workstring for deflation of said inflatable packer to release said resettable wellbore tool from said setting engagement at a first depth within said wellbore, and reinflation of said inflatable packer to again urge said resettable wellbore tool into said setting engagement at a second depth within said wellbore on a single trip within said wellbore.

2. The resettable wellbore tool of claim 1, wherein said source of pressurized fluid is run within said workstring and selectively coupled to said resettable wellbore tool for transmitting said pressurized fluid to said resettable wellbore tool.

3. The resettable wellbore tool of claim 1, wherein said source of pressurized fluid includes a continuous tubing string run within said workstring for transmitting said pressurized fluid from a ground surface above said wellbore to said resettable wellbore tool.

4. The resettable wellbore tool of claim 1, wherein passing said pressurized fluid into said inflatable element urges said inflatable packer into a radially expanded position into said setting position in said setting engagement with said wellbore surface.

5. The resettable wellbore tool of claim 1, wherein said setting engagement between said inflatable packer and said wellbore surface is a gripping and sealing engagement.

6. The resettable wellbore tool of claim 1, wherein said wellbore surface is an interior surface of a casing disposed within said wellbore.

7. The resettable wellbore tool of claim 1, wherein said fluid flowpath is a singular-continuous pathway disposed between said inflatable element and said fluid control member.

8. The resettable wellbore tool of claim 1, wherein said fluid control member is operable for locking out a fluid pressure within said workstring from said fluid flowpath of said resettable wellbore tool to allow said fluid pressure to be applied down said workstring without setting said resettable wellbore tool.

9. The resettable wellbore tool of claim 1 further comprising:

a landing nipple secured to a lower end of said mandrel; and a retrievable plug seated within said landing nipple for sealing a fluid flowpath through a central bore of said resettable wellbore tool.

10. The resettable wellbore tool of claim 1, wherein said at least one inflation port is disposed interiorly about said mandrel for passing said pressurized fluid from an interior of said mandrel into said fluid flowpath; and wherein said at least one deflation port is disposed exteriorly about said mandrel for passing said pressurized fluid from said fluid flowpath to an annulus defined between said mandrel and said wellbore surface.

11. The resettable wellbore tool of claim 10, wherein said fluid control member is a singular unit disposed about one longitudinal end of said inflatable element, and said fluid control member includes:

a pressurization valve having said at least one valve member which is repeatably moveable about said at least one inflation port for selectively passing said pressurized fluid through said at least one inflation port to control inflating and deflating of said inflatable packer, and unlatching and latching of said release latch;

a deflation valve having a moveable valve member, wherein said moveable valve member is a spring biased sleeve piston which is repeatably moveable about said at least one deflation port between a plurality of deflation valve positions which include:

an inflation position for passing said pressurized fluid from within said fluid flowpath, through said fluid flowpath, and into said inflation chamber for inflating said inflatable packer; and a deflation position for passing said pressurized fluid from said inflation chamber, through said at least one deflation port, and directly into said annulus for deflating said inflatable packer and equalizing pressure between said inflatable element and said annulus.

12. The resettable wellbore tool of claim 1, wherein said latch member of said release latch can only be moved from said latched position to said unlatched position when said resettable wellbore tool is in said setting engagement.

13. The resettable wellbore tool of claim 12, wherein said release latch includes:

said latch member defining a collet latch having at least one shoulder which is moveable into said latched position for releasably engaging at least one mating shoulder and securing said inflatable packer to said workstring;

a locking device abutting said collet latch for preventing movement of said collet latch between said latched position and said unlatched position, said locking device moveable aside of said collet latch for allowing movement of said collet latch between said latched position and said unlatched position;

a lock sleeve which is coupled to a spring biased sleeve piston which is moved between a latch locked position and a latch unlocked position by said pressurized fluid within said fluid flowpath and said spring biased sleeve;

said spring biased sleeve urging said lock sleeve into said latch locked position abutting said locking device for preventing said locking device from moving aside from abutting said collet latch for preventing release of said inflatable packer from said workstring; and said pressurized fluid within said fluid flowpath, when retaining said resettable wellbore tool in said setting engagement, moving said spring biased sleeve and urging said lock sleeve into said latch unlocked position aside of said locking device for allowing said locking device to move aside of said collet latch and said inflatable packer to release from said workstring.

14. The resettable wellbore tool of claim 1, wherein said resettable wellbore tool is selectively releasable from said setting engagement with said wellbore surface after a production tubing string is run into said wellbore subsequent to removing said workstring from said wellbore.

15. The resettable wellbore tool of claim 1, wherein said resettable wellbore tool is retrievable through a production tubing string run into said wellbore subsequent to removing said workstring from said wellbore.

16. A resettable wellbore tool for running into a wellbore on a workstring and operating by application of a pressurized fluid which urges said resettable wellbore tool into a setting position in a setting engagement with a wellbore surface, said resettable wellbore tool comprising:

an inflatable packer having a mandrel, an inflatable element retained about said mandrel, a fluid flowpath for passing said pressurized fluid to said inflatable element, at least one inflation port for passing said pressurized fluid into said fluid flowpath, and at least one deflation port for passing said pressurized fluid from said inflatable element;

a release latch for selectively releasing said inflatable packer from said workstring, and for selectively relatching said inflatable packer to said workstring;

a fluid control means for controlling flow of said pressurized fluid through said inflation port and into said fluid flowpath, and for controlling flow of said pressurized fluid from said inflatable element and through said deflation port, said fluid control means resettable in a plurality of positions which include:

an inflation position for passing said pressurized fluid through said inflation port and into said inflatable element for inflating said inflatable packer into said setting engagement with said wellbore surface;

a locking position for retaining said pressurized fluid within said inflatable element, said fluid control member operable in said locking position during operation of said release latch in which said workstring is selectively released from said inflatable packer;

a deflation position for passing said pressurized fluid from said inflatable element, through said deflation port, and into said wellbore for deflation of said inflatable element; and a reinflation position for passing said pressurized fluid through said inflation port to reinflate said inflatable element for resetting said inflatable packer in said setting engagement with said wellbore surface after deflation from said setting engagement.

17. The resettable wellbore tool of claim 16, wherein actuation of said fluid control means into said reinflation position resets said fluid control means into said inflation position, and said fluid control means is multiply resettable into said plurality of positions.

18. The resettable wellbore tool of claim 16, wherein said fluid control means, when disposed in said locking position, prevents inflation of said inflatable packer.

19. The resettable wellbore tool of claim 16, wherein said deflation port, when said fluid control means is in said deflation position, passes said pressurized fluid from said inflatable element, through said fluid flowpath, and directly to an annulus defined between said inflatable packer and said wellbore surface.

20. The resettable wellbore tool of claim 19, wherein said fluid control means is resettable for passage of said pressurized fluid through said deflation port after reinflation of said inflatable element.

21. The resettable wellbore tool of claim 16 wherein said release latch for selectively releasing and relatching said inflatable packer from said workstring is operable in a plurality of release latch positions which include:

a latched position for moving said inflatable packer between different wellbore depths, inflating said inflatable packer, deflating said inflatable packer, and reinflating said inflatable packer;

a released position for moving said workstring independent of said inflatable packer; and a relatched position for deflating said inflatable packer, moving said inflatable packer between different wellbore depths, and reinflating said inflatable packer for resetting said resettable wellbore tool.

22. The resettable wellbore tool of claim 21, wherein said release latch is urged into said released position by said pressurized fluid inflating said inflatable element into said setting engagement with said wellbore surface;

wherein said release latch is retained in said released position by said pressurized fluid retained within said inflatable element by said fluid control means disposed in said locking position; and wherein said release latch is relatched by said fluid control means releasing said pressurized fluid from said inflatable element, which deflates said inflatable element and resets said release latch to said latched position.

23. The resettable wellbore tool of claim 16, wherein said resettable wellbore tool is selectively releasable from said setting engagement with said wellbore surface after a production tubing string is run into said wellbore subsequent to removing said workstring from said wellbore.

24. The resettable wellbore tool of claim 16, wherein said resettable wellbore tool is retrievable through a production tubing string run into said wellbore subsequent to removing said workstring from said wellbore.

25. A resettable wellbore tool for running into a wellbore on a workstring and operating by application of a pressurized fluid which urges said resettable wellbore tool into a setting position in a setting engagement with a wellbore surface, said resettable wellbore tool comprising:

an inflatable packer which includes a mandrel extending longitudinally within said resettable wellbore tool, an inflatable element disposed around said mandrel and having an inflation chamber defined therebetween, and at least one retainer member for retaining said inflatable element about said mandrel;

a fluid flowpath extending about said mandrel and within said inflatable element for passing said pressurized fluid between a plurality of ports and said inflation chamber, said plurality of ports including:

at least one inflation port for passing said pressurized fluid from a source of pressurized fluid and into said inflation chamber;

at least one deflation port for passing said pressurized fluid from said inflation chamber and into an annulus defined between said inflatable packer and said wellbore surface;

a fluid control member which is selectively resettable in a plurality of positions for selectively sealing said plurality of ports, said plurality of positions including:

an inflation position for selectively passing said pressurized fluid through said at least one inflation port to said inflation chamber and urging said inflatable element into said setting engagement with said wellbore surface;

a locking position for locking said pressurized fluid within said inflation chamber and retaining said inflatable element in said setting engagement with said wellbore surface;

a deflation position for selectively passing said pressurized fluid from said inflation chamber and through said at least one deflation port for resetting said inflatable element in a deflated position;

a reinflation position for selectively passing said pressurized fluid through said at least one inflation port to said inflation chamber and urging said inflatable element to return to said setting engagement with said wellbore surface; and a release latch for selectively releasing said inflatable packer from said workstring, and for selectively relatching said inflatable packer to said workstring for further operations including repositioning and resetting said inflatable packer at different depths within said wellbore.

26. The resettable wellbore tool of claim 25, wherein said fluid control member includes:

a pressurization valve resettable into a plurality of pressurization valve positions, including an open and a closed positions, said open position for selectively communicating said pressurized fluid from said source of pressurized fluid to said fluid flowpath for passage to said inflatable packer, and said closed position providing said locking position for locking said pressurized fluid within said fluid flowpath and said inflatable packer; and a deflation valve resettable into a plurality of deflation valve positions, including said inflation and said deflation positions, said deflation position further defined to include selectively passing said pressurized fluid from said inflatable packer directly to an annulus defined between said wellbore surface and said resettable wellbore tool.

27. The resettable wellbore tool of claim 26, wherein said fluid control member further includes:

said pressurization valve having a sleeve which is moveable within said mandrel and about said at least one inflation port for positioning in said open position and said closed position; and said deflation valve having a spring biased sleeve piston which is moveable about at least one deflation port and a fluid flow-path for positioning in said inflation and said deflation positions.

28. The resettable wellbore tool of claim 25, wherein said release latch for selectively releasing and relatching said inflatable packer from said workstring includes:

a hydraulic lock having a locking dog and a lock sleeve, said lock sleeve urged from a latch locked to a latch unlocked position by application of an inflation pressure applied by said pressurized fluid to said inflatable element and said lock sleeve;

a collet latch having at least one shoulder which releasably engages at least one mating shoulder for selectively securing said inflatable packer to said workstring, said collet latch secured in a latched position by said hydraulic lock disposed in said latch locked position, and releasable from and resecurable into said latched position during positioning of said hydraulic lock in said latch unlocked position; and said collet latch resettable into said latched position and said hydraulic lock resettable into said latch locked position for further manipulation of said inflatable packer between inflation and deflation positions, and resetting of said inflatable packer at said different depth within said wellbore.

29. The resettable wellbore tool of claim 25, wherein said resettable wellbore tool is selectively releasable from said setting engagement with said wellbore surface after a production tubing string is run into said wellbore subsequent to removing said workstring from said wellbore.

30. The resettable wellbore tool of claim 25, wherein said resettable wellbore tool is retrievable through a production tubing string run into said wellbore subsequent to removing said workstring from said wellbore.

31. A resettable wellbore tool for running into a wellbore on a workstring and operating by application of a pressurized fluid which urges said resettable wellbore tool into a setting position in a setting engagement with a wellbore surface, said resettable wellbore tool comprising:

an inflatable packer having a mandrel, an inflatable element retained about said mandrel, a fluid flowpath for passing said pressurized fluid to said inflatable element, at least one inflation port for passing said pressurized fluid into said fluid flowpath, and at least one deflation port for passing said pressurized fluid from said inflatable element;

a release latch for selectively releasing said inflatable packer from said workstring, and for selectively relatching said inflatable packer to said workstring;

a fluid control means for controlling flow of said pressurized fluid through said inflation port and into said fluid flowpath, and for controlling flow of said pressurized fluid from said inflatable element and through said deflation port, said fluid control means resettable in a plurality of positions which include:

an inflation position for passing said pressurized fluid through said inflation port and to said inflatable element for inflating said inflatable element into said setting engagement with said wellbore surface;

a locking position for retaining said pressurized fluid within said inflatable element, said fluid control means operable in said locking position during operation of said release latch to selectively release said mandrel from said inflatable packer;

a deflation position for passing said pressurized fluid from said inflatable element, through said deflation port, and to said wellbore for deflation of said inflatable element; and a source of pressurized fluid which is run within said workstring and selectively coupled to said resettable wellbore tool for transmitting said pressurized fluid to said resettable wellbore tool.

32. The resettable wellbore tool of claim 31, wherein said source of pressurized fluid includes a continuous tubing string run within said workstring for transmitting said pressurized fluid from a ground surface above said wellbore to said resettable wellbore tool.

33. The resettable wellbore tool of claim 31, wherein said workstring includes an upper wellbore tool for running in said workstring above said resettable wellbore tool, said upper wellbore tool including a fluid circulation flowpath for passing a circulation fluid between a central bore of said workstring and a wellbore annulus disposed exteriorly about said workstring.

34. The resettable wellbore tool of claim 33, wherein said upper wellbore tool is a well treatment tool for passing a well treatment fluid from said central bore of said workstring into an earth formation within which said wellbore is disposed.

35. The resettable wellbore tool of claim 31, wherein said fluid control means includes:

a pressurization valve resettable into a plurality of pressurization valve positions, including an open and a closed positions, said open position for selectively communicating said pressurized fluid from said source of pressurized fluid, through said inflation port, and to said fluid flowpath for passage to an interior of said inflatable element, and said closed position for providing said locking position for said fluid control means; and a deflation valve resettable into a plurality of deflation valve positions, including said inflation and said deflation positions, said deflation position including passing said pressurized fluid from said interior of said inflatable element, through said fluid flowpath, and through said deflation port directly to an annulus defined between said wellbore surface and said resettable wellbore tool.

36. The resettable wellbore tool of claim 31, wherein said resettable wellbore tool is selectively releasable from said setting engagement with said wellbore surface after a production tubing string is run into said wellbore subsequent to removing said workstring from said wellbore.

37. The resettable wellbore tool of claim 31, wherein said resettable wellbore tool is retrievable through a production tubing string run into said wellbore subsequent to removing said workstring from said wellbore.

38. A resettable wellbore tool for running into a wellbore on a workstring to a setting depth within said wellbore, setting in a setting engagement with said wellbore, releasing from said setting engagement with said wellbore at said setting depth, and retrieving from said wellbore, said resettable wellbore tool comprising:

a wellbore tool member operable in a plurality of positions, which include a first position and a second position;

a release latch for selectively securing said wellbore tool member to said workstring, and which is operable both for releasing said wellbore tool member from said workstring and for relatching said wellbore tool member to said workstring;

a locking member for selectively locking said release latch in a latched position, said locking member operable in a plurality of positions which include:

a latch locked position which retains said release latch in a latched position securing said wellbore tool member to said workstring during operation of said wellbore tool member in said first position;

a latch unlocked position which releases said release latch to allow retrieval of said workstring independent of said wellbore tool member during operation of said wellbore tool member in said second position;

a latch relocked position which retains said release latch in said latched position for resecuring said wellbore tool member to said workstring for retrieval of said wellbore tool member after removal of said wellbore tool member from said second position;

a fluid actuated wellbore tool which is urged into an actuated position by application of a pressurized fluid which urges said fluid actuated wellbore tool to a set position;

a fluid control member for controlling flow of said pressurized fluid to said fluid actuated wellbore tool, said fluid control member selectively resettable in a plurality of positions which include:

an open position for passing said pressurized fluid from a source of pressurized fluid to said fluid actuated wellbore tool;

a closed position for locking said pressurized fluid within said fluid actuated wellbore tool; and a fluid flowpath for communicating said pressurized fluid locked within said fluid actuated wellbore tool with said locking member for automatically urging said locking member into said latch unlocked position after said pressurized fluid urges said fluid actuated wellbore tool into said actuated position.

39. A resettable wellbore tool for running into a wellbore on a workstring to a setting depth within said wellbore, setting in a setting engagement with said wellbore, releasing from said setting engagement with said wellbore at said setting depth, and retrieving from said wellbore, said resettable wellbore tool comprising:

a wellbore tool member operable in a plurality of positions, which include a first position and a second position;

a release latch for selectively securing said wellbore tool member to said workstring, and which is operable both for releasing said wellbore tool member from said workstring and for relatching said wellbore tool member to said workstring;

a locking member for selectively locking said release latch in a latched position, said locking member operable in a plurality of positions which include:

a latch locked position which retains said release latch in a latched position securing said wellbore tool member to said workstring during operation of said wellbore tool member in said first position;

a latch unlocked position which releases said release latch to allow retrieval of said workstring independent of said wellbore tool member during operation of said wellbore tool member in said second position;

a latch relocked position which retains said release latch in said latched position for resecuring said wellbore tool member to said workstring for retrieval of said wellbore tool member after removal of said wellbore tool member from said second position;

said wellbore tool member including an inflatable packer having a mandrel, an inflatable element retained about said mandrel, and a fluid flowpath for passing a pressurized fluid to said inflatable element, said inflatable packer operable in a plurality of positions which include:

a deflated position defining said first position in which said wellbore tool member is operable, and in which said locking member is in said latch locked position retaining said release latch in said latched position;

an inflated position defining said second position in which said wellbore tool member is operable, and in which said locking member is automatically urged and retained in said latch unlocked position allowing release of said workstring from said wellbore tool member;

said wellbore tool member further including a fluid control member for controlling flow of said pressurized fluid through said fluid flowpath, said fluid control member resettable in a plurality of positions which include:

an inflating position for passing said pressurized fluid to said inflatable element for inflating said inflatable element into said setting engagement with said wellbore surface;

a locked position for retaining said pressurized fluid within said inflatable element and locking said locking member in said latch unlocked position for retaining said release latch in said released position, said fluid control member operable in said locking position during operation of said release latch to selectively release said workstring from said inflatable packer; and a deflation position for passing said pressurized fluid from said inflatable element to said wellbore for deflation of said inflatable packer to said second position.

40. The resettable wellbore tool of claims 39 or 39, wherein said resettable wellbore tool is selectively releasable from said setting engagement within said wellbore after a production tubing string is run into said wellbore subsequent to removing said workstring from said wellbore.

41. The resettable wellbore tool of claims 38 or 39, wherein said resettable wellbore tool is retrievable through a production tubing string run into said wellbore subsequent to removing said workstring from said wellbore.

42. The resettable wellborn of claims 38 or 39, wherein said wellbore tool is resettable into said second position after resetting said release latch into said latched position and resecuring said wellbore tool member to said workstring.

* * * * *